US009770820B1

(12) United States Patent
Ragner

(10) Patent No.: US 9,770,820 B1
(45) Date of Patent: Sep. 26, 2017

(54) FOLDING PLIERS WITH FULL WRENCH SET

(71) Applicant: Gary Dean Ragner, Gainesville, FL (US)

(72) Inventor: Gary Dean Ragner, Gainesville, FL (US)

( * ) Notice: Subject to any disclaimer, the term of this patent is extended or adjusted under 35 U.S.C. 154(b) by 146 days.

(21) Appl. No.: 14/265,334

(22) Filed: Apr. 29, 2014

Related U.S. Application Data

(60) Provisional application No. 61/817,254, filed on Apr. 29, 2013.

(51) Int. Cl.
*B25F 1/04* (2006.01)
*B25F 1/00* (2006.01)

(52) U.S. Cl.
CPC ..... *B25F 1/04* (2013.01); *B25F 1/006* (2013.01)

(58) Field of Classification Search
CPC .... B25F 1/00; B25F 1/003; B25F 1/02; B25F 1/04; B25G 1/025; B25G 1/08; B25G 1/085; B25B 7/22
USPC ..... 7/127, 128
See application file for complete search history.

(56) References Cited

U.S. PATENT DOCUMENTS 415,923 A * 11/1889 Painter ..... B25F 1/003 7/128
119,441 A 1/1940 Sandy
D119,441 S * 3/1940 Sandy ..... 7/100
D136,188 S * 8/1943 Payne ..... 7/127
3,946,453 A 3/1976 Torres
4,995,128 A * 2/1991 Montgomery ..... B25B 7/02 7/127
5,062,173 A * 11/1991 Collins ..... B25B 7/00 30/255
D327,208 S 6/1992 Wehling
5,267,366 A * 12/1993 Frazer ..... B25F 1/04 7/128
5,809,599 A 9/1998 Frazer
D401,133 S 11/1998 Gardiner et al.
6,003,180 A 12/1999 Frazer
6,009,582 A * 1/2000 Harrison ..... B25F 1/003 30/161
6,219,870 B1 * 4/2001 Swinden ..... B25F 1/003 7/118
6,289,773 B1 * 9/2001 Patry ..... B25B 13/08 7/138
6,430,768 B2 8/2002 McIntosh et al.
6,481,034 B2 * 11/2002 Elsener ..... B25F 1/003 30/161
6,694,558 B2 2/2004 Ping
(Continued)

OTHER PUBLICATIONS

Crescent® ProSeries long needle nose compound pliers PS6549C—Pictures of Product.

*Primary Examiner* — David B Thomas
(74) *Attorney, Agent, or Firm* — Emerson, Thomson & Bennett, LLC

(57) ABSTRACT

A folding multitool comprising a pliers head assembly with at least two pivotal tool arms that are foldable to a stowed position and an extended operational position. The pivotal tool arms define at least one wrench head on their outer end with at least two gripping surfaces for turning at least two different sized rotary fasteners. Wherein each pivotal tool arm can be used either as a tool handle or as a tool arm depending on the position of the pivotal tool arms and which end of the extended multitool the user grasps.

20 Claims, 8 Drawing Sheets

(56) References Cited

Figure 3A:
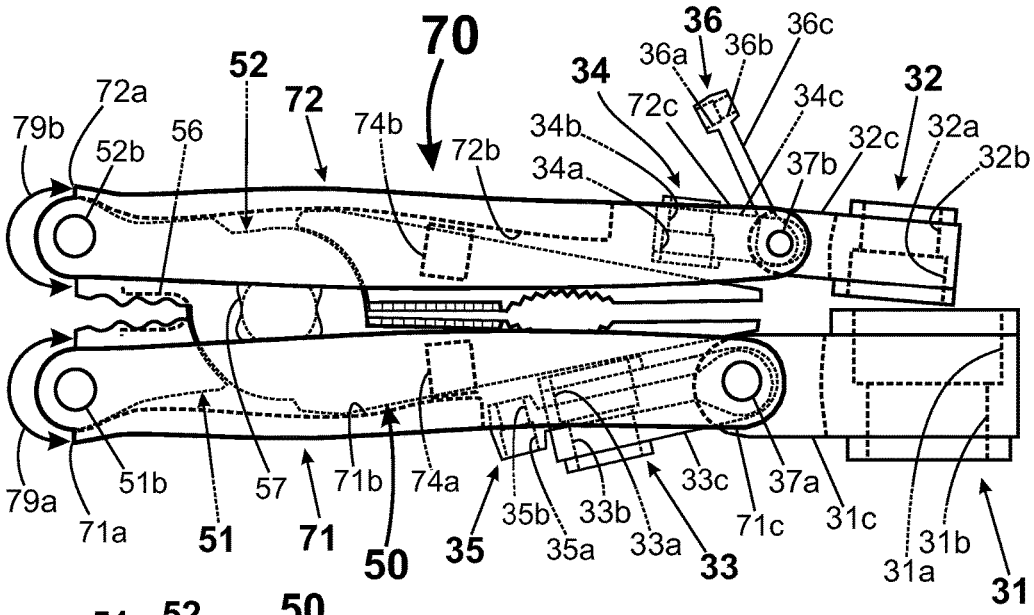

U.S. PATENT DOCUMENTS 6,983,505 B2 1/2006 McIntosh et al.
6,983,506 B1 * 1/2006 Brown ..... B25F 1/003 7/118
7,334,502 B1 * 2/2008 Durkee ..... B25B 7/22 7/127
7,467,574 B1 * 12/2008 Lin ..... B25B 13/461 81/177.85
7,568,408 B2 8/2009 Tsuda
7,735,399 B2 6/2010 Robinson et al.
7,997,170 B1 * 8/2011 Martinez ..... B25B 7/00 7/128
8,430,003 B1 * 4/2013 Johnson ..... B23Q 13/00 81/427.5
8,549,687 B1 * 10/2013 Alexander ..... B25B 23/0007 7/128
8,783,138 B2 * 7/2014 Johnson ..... B23Q 13/00 81/439
8,875,601 B2 * 11/2014 Johnson ..... B25B 15/008 7/168
8,955,416 B1 * 2/2015 Ragner ..... B25F 1/04 81/124.4
9,089,955 B2 * 7/2015 Johnson ..... B25B 23/0028 81/60
9,089,960 B2 * 7/2015 Wang ..... B25F 1/04 81/440
9,289,891 B1 * 3/2016 Ragner ..... B25F 1/04 7/127
2002/0194679 A1 12/2002 Hawkins
2006/0236823 A1 * 10/2006 MacLain ..... B25B 7/02 81/418
2007/0186351 A1 * 8/2007 Linn ..... B25F 1/003 7/129
2010/0088826 A1 * 4/2010 Chen ..... B25F 1/04 7/138
2013/0025071 A1 * 1/2013 Keng ..... B25F 1/003 7/118

* cited by examiner

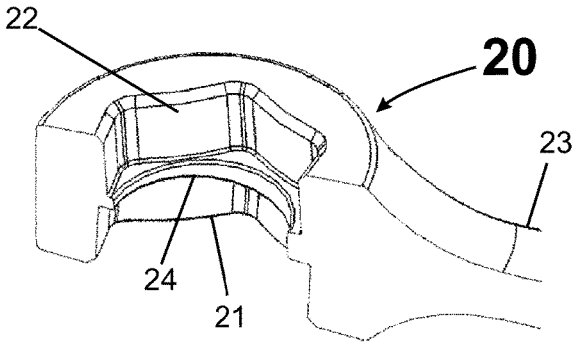
Fig. 1A - Prior Art
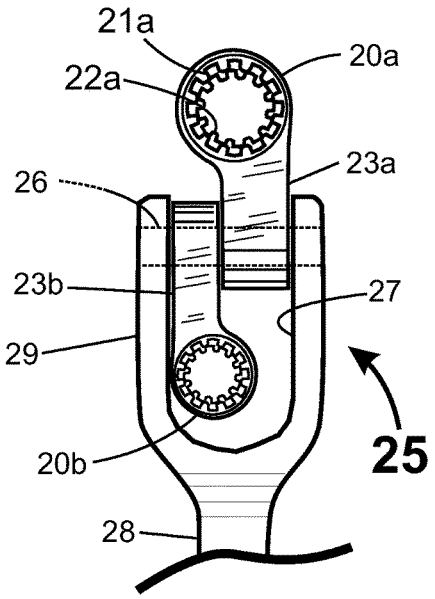
Fig. 1B
Prior Art
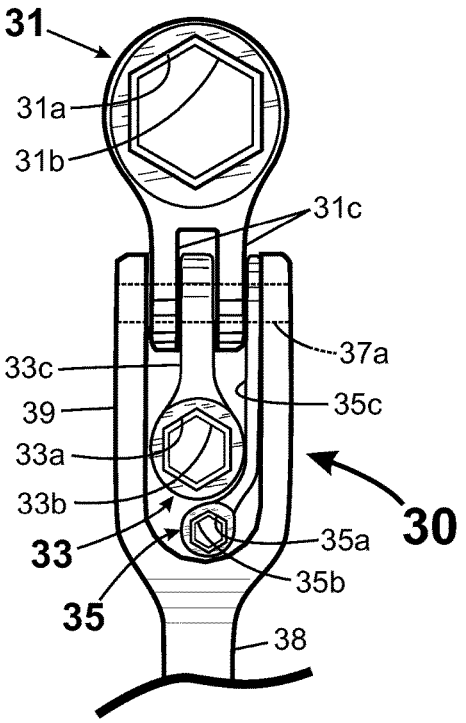
Fig. 1C
Prior Art
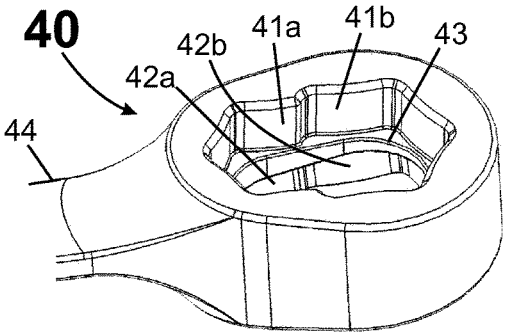
Fig. 1D
Prior Art

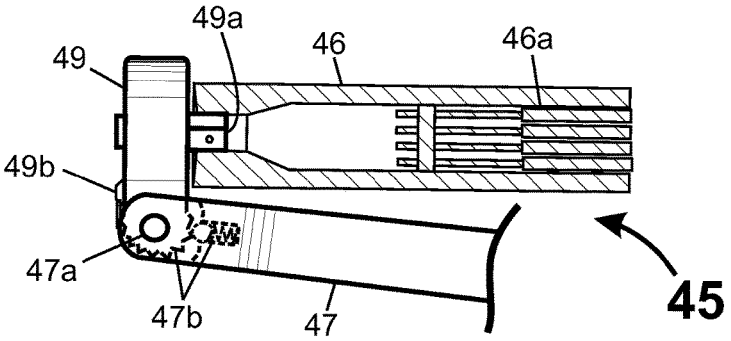
Fig. 2A - Prior Art
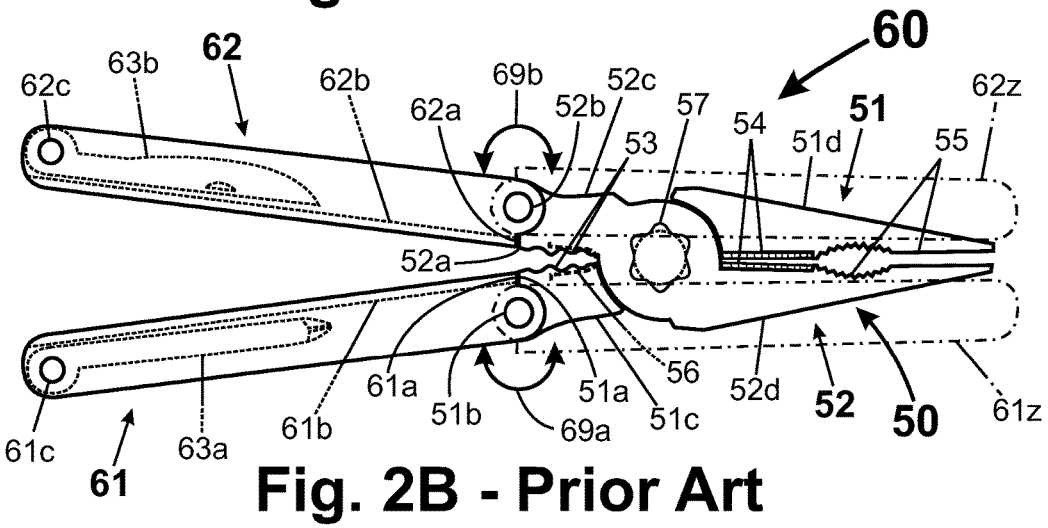
Fig. 2B - Prior Art
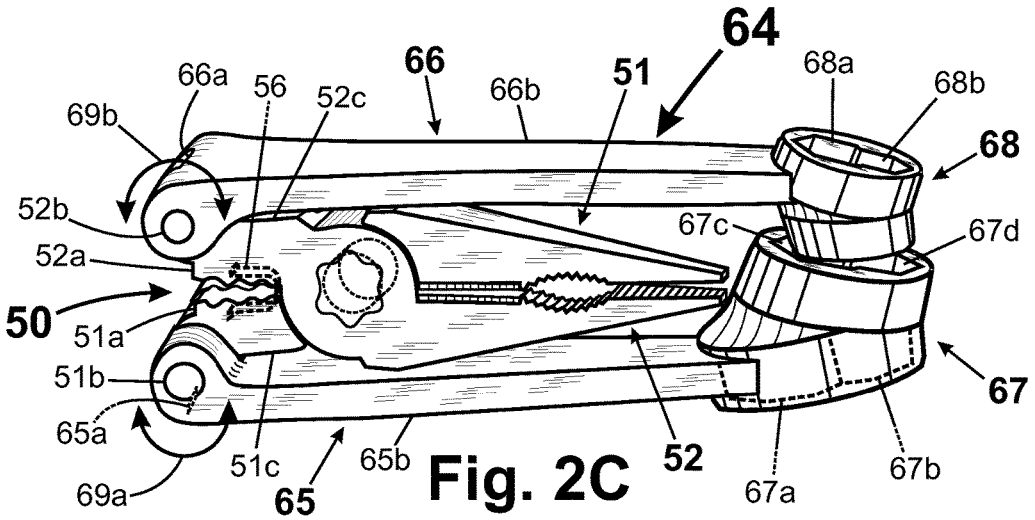
Fig. 2C

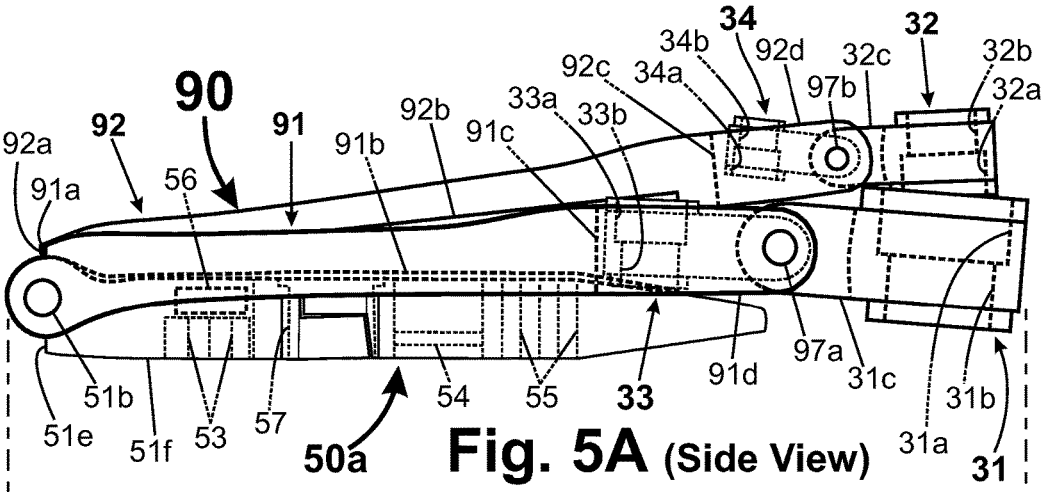
Fig. 5A (Side View)
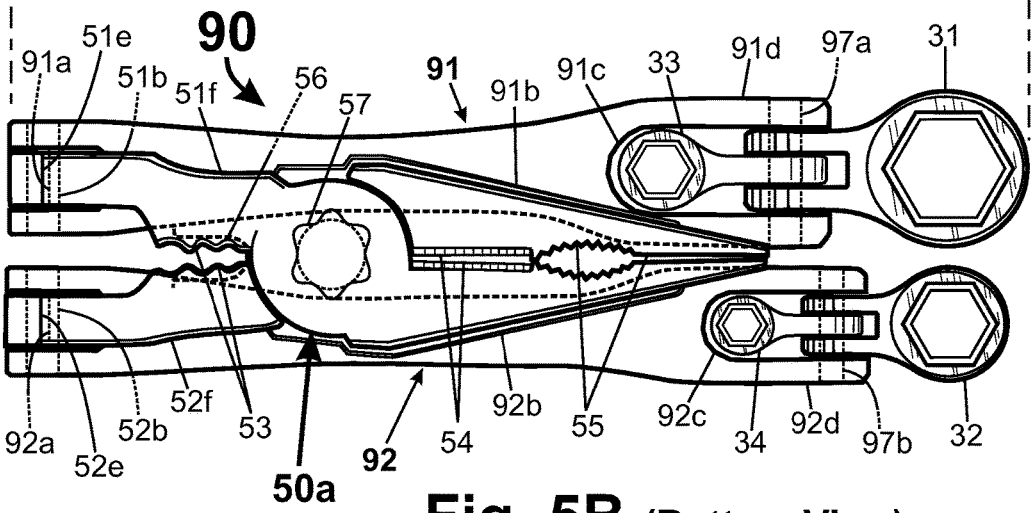
Fig. 5B (Bottom View)
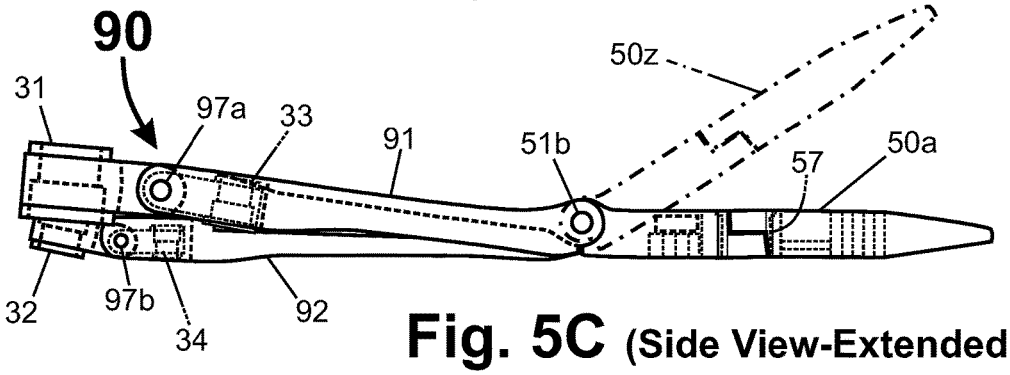
Fig. 5C (Side View-Extended)

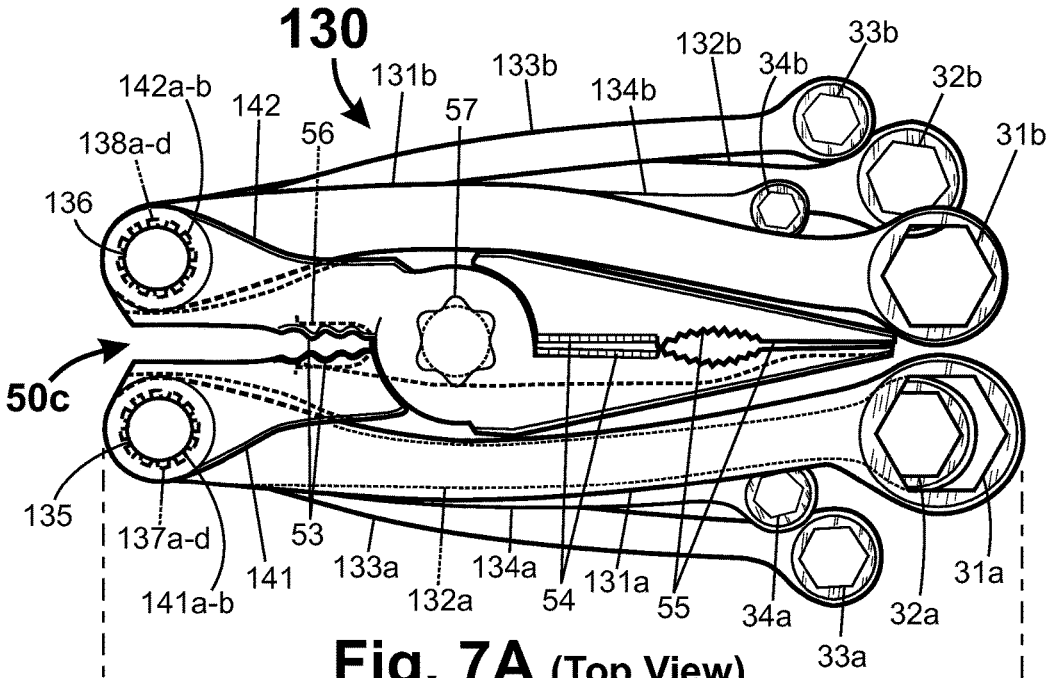
Fig. 7A (Top View)
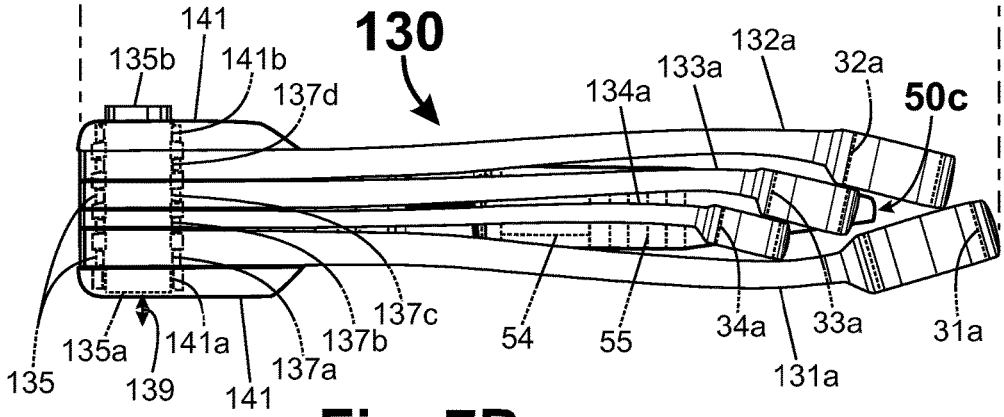
Fig. 7B (Side View)

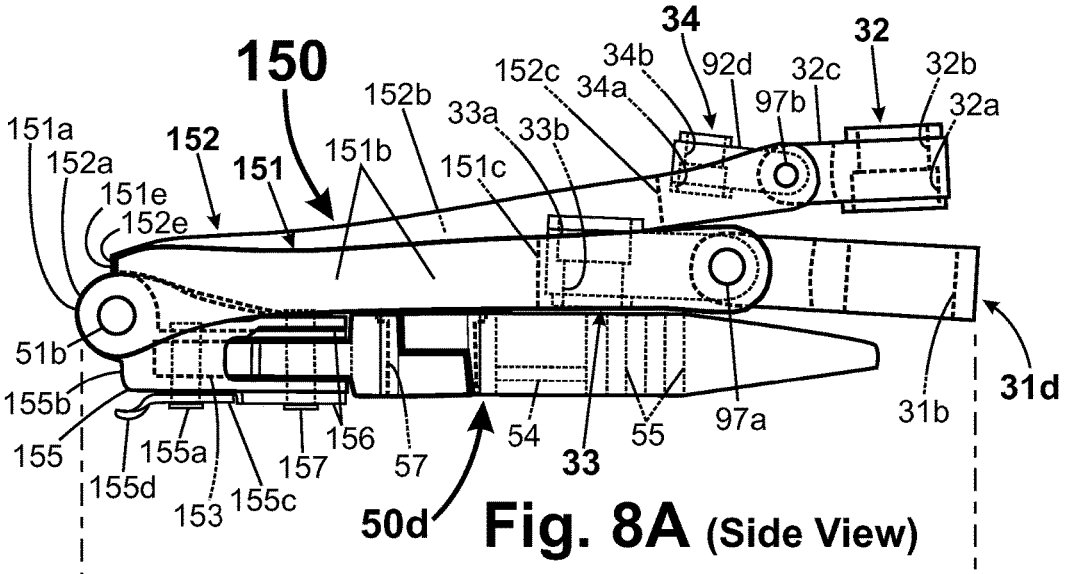
Fig. 8A (Side View)
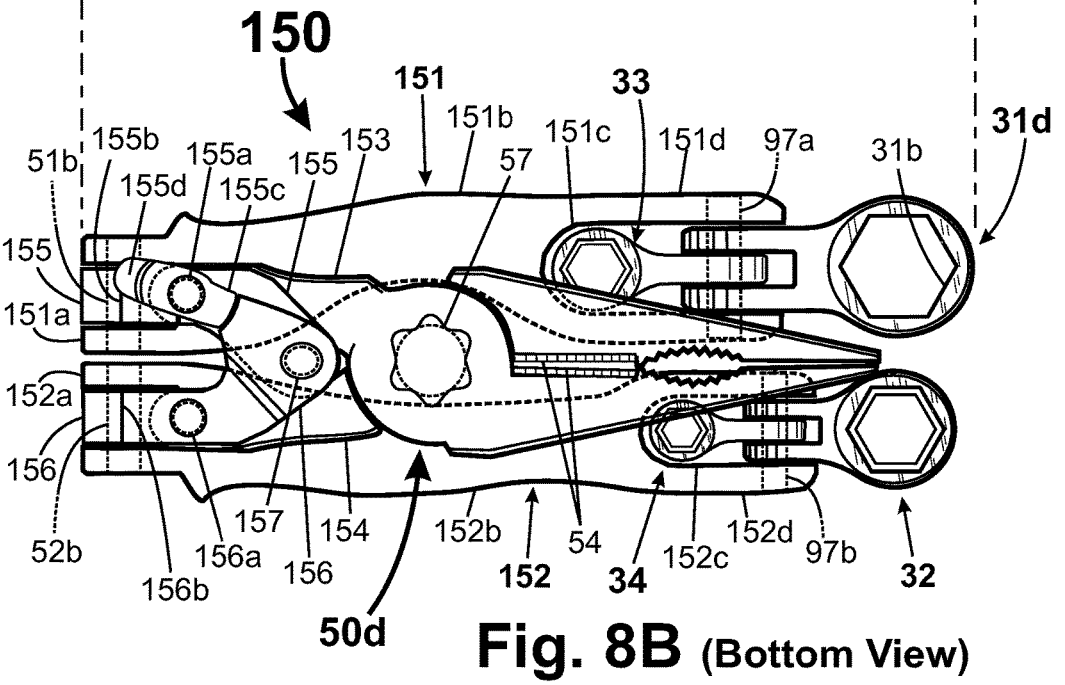
Fig. 8B (Bottom View)

FOLDING PLIERS WITH FULL WRENCH SET

CROSS-REFERENCE TO RELATED APPLICATIONS

This non-provisional application claims priority and benefit from U.S. Provisional Application Ser. No. 61/817,254, filed on Apr. 29, 2013, titled: "FOLDING PLIERS WITH FULL WRENCH SET" by the same inventor, the disclosure of which is hereby incorporated by reference in its entirety.

FIELD OF INVENTION

The field of this invention relates to hand tools that comprise both pliers and two or more wrench tools, and more specifically to pliers with folding handles having wrench and/or socket tools.

BACKGROUND OF INVENTION

The present state of the art for hand tools is very diverse. Wrenches, ratchet wrenches, and sockets, are all used for turning rotary fasteners and normally come in sets of five or more individual sizes. These sets often come with a carrying case or other holding structure to keep the wrench and socket tools together. Wrench designs with two, three, four or more gripping surface sizes per wrench head can be found in the prior art. Wrench sockets also come in multi-size configurations using either slidable pins, posts, and/or sleeves to adjust the size of sockets effective gripping surface. These wrench sets, socket sets, and socket sets allow the user to tighten and loosen rotary fasteners (bolts, screws, nuts, specialty fasteners, and etc.) of a variety of sizes. The disclosed folding pliers can have many different styles of gripping surfaces and can have two or more individual sizes per plier handle.

Most American homes have at least one wrench set or socket set in their home, because of the universal nature of wrenches and sockets. Thus, each folding pliers example presented in this patent includes a full set of wrenches or socket sizes. However, other tools can be substituted for one or more of these wrenches or sockets. Prior art sockets and ratchet wrenches include a multitude of ways of providing torque to various rotary fasteners, and can include a ratchet mechanism that can be bidirectional (selectively reversible) or unidirectional (ratchet action only in one direction). Along with the pliers and multiple wrenches and/or socket sizes, this invention can also comprise other tools, such as, but not limited to, hammers, screwdrivers, pry bars, scraping tools, box cutters, knives, saws, ratchet drivers (for sockets), files (wood and/or metal), axes, and other hand tools. The wrench and socket heads themselves can have a pivot hinge, pin, or knobs that allow the tool to swivel to various angles to allow greater functionality, and can be designed to pivot to a low-profile position for stowage.

The wrench heads can each come with a variety of gripping surfaces for use with different types of fasteners. The gripping surfaces commonly used today comprise: 1) four-point standard (square shape), 2) six-point standard (hexagon shape), 3) twelve-point standard (double hexagon), 4) twelve-point spline, 5) lobed gripping surfaces (both six and twelve point), 6) Torex® gripping surfaces, 7) asymmetric gripping surfaces, 8) variations on these basic gripping surfaces, and 9) many other shape specialty shapes for various purposes. This list of gripping surfaces is not exhaustive and many other gripping surface designs exist in the patent record that can be used with the disclosed folding wrench system.

PRIOR ART

In the prior art, the use of standard wrenches and sockets is extensive. Wrenches and sockets with two or more gripping surface sizes are taught for use. Many wrench designs exist in the prior art that provide multiple wrenches and sockets. However, no folding pliers were found that are combined with folding wrench arms having two or more separate wrench or socket sizes where the folding wrench arms are also used as handles for the pliers.

A multitude of folding pliers patents exist in the prior art, such as U.S. Pat. No. 6,694,558 to Ping, and U.S. Pat. No. 6,983,505 to Mcintosh show a pliers with folding handles that include additional tools pivotal on the folding handles. However, no prior art folding pliers were found at this time which comprise a full set of wrench heads or wrench socket sizes and can fold to a stowed position.

SUMMARY

The disclosed folding pliers combine a pliers' head with a full set of wrenches and/or sockets to provide an ergonomic multitool that has a stow position that is significantly shorter than its pliers' operational position. The stowed position can be achieved by folding the handles, wrenches and/or sockets adjacent the pliers' head. The pliers assembly of each multitool can comprise any of a number ofpliers designs, including, but not limited to, needle-nose pliers, combination pliers, cutting pliers, locking pliers, linesmen's pliers, punch pliers, slip-joint pliers, three-prong pliers, compound pliers and other specialty pliers. Most prior art pliers designs can be made ready for use with the disclosed pliers multitools by simply shortening the pliers handles, adding folding hinges and pivot stops so that folding wrench arms can be attached. Thus, nearly any type of pliers can used with the disclosed multitool. The pliers design shown in the examples presented here combine a number of common pliers: 1) a needle-nose pliers, 2) a cutting pliers, and 3) a wire stripper and crimping tool into a single pliers head. Limits on space do not allow examples of the numerous pliers types and pliers combinations that can be used in place of the disclosed pliers head assemblies. For example, one of my favorite pliers is Crescent® ProSeries long needle nose compound pliers PS6549C, which provides a compound leverage design that increases gripping and cutting force by approximately fifty percent (see FIGS. 8A-B). Crescent's prior art design is shown modified in FIGS. 8A-B with a pair of folding wrench arm/handles 151 and 152 which can be similar to other folding wrench arm/handles 65, 66, 71, 72, 82, 82, 91, 92, 93, 94, 95 and 96 along with their respective wrench heads and/or multisockets. The patent record is full of other possible pliers types and combinations that can be used with the disclosed multiwrench and multisocket folding arms. Nearly any prior art pliers can be substituted for pliers head assembly 50 including more complex pliers designs such as combination pliers and locking pliers (vise grips). In FIG. 2C, we see that the shortened plier arms 51*c* and 52*c* are used so that folding handles 65 and 66 can be folded to a compact stowed position. In alternate designs the folding handle hinges can be eliminated if the user does not need the pliers to fold to a compact stowed position. For example, on folding pliers 70, seen in FIGS. 3A-C, hinge pins 51*b* and 52*b* can be eliminated, and handle 71 combined with plier arm 51*c*, and handle 72 combined with plier arm 52*c* in their extended position (see FIG. 3C). Then if pliers hinge 57 allows the disassembly of pliers head 50, all the wrench heads can be used with its respective half of the multitool, using its pliers head portion as the handle. The two halves would be reattached at hinge 57 for use as a needle nose pliers, cutting pliers, or crimping or stripping tool.

The disclosed pliers multitools, can include hinges to extend the handles for use of both the wrenches/sockets, and the pliers. The folding hinges are located near the middle of the extended multitool to allow the pliers to fold roughly in half for a more compact stowed position. The multitool can have more than one operational position which can comprise: 1) a screwdriver handle position (gripping surface axis substantially parallel to the handles), 2) a short handle position (handles folded next to pliers), 3) a crank handle position (gripping surface axis substantially parallel to the wrench handle being used as the crank handle), 4) driver handle position (handles pivoted at ninety degrees to the wrench handle and wrench head pivoted parallel to handle), 5) a long handle position (handle unfolded to provide an extended handle), 6) an extra long handle position (for socket is extended along with its handle), 7) two handle position (on three or more handle multitools), and 8) pliers handle position (handles folded out to be used as plier handles), and many angled positions between these distinct orientations. And of course each multitool can have a stowed position. Each positional configuration has its own advantages and disadvantages during actual operation. The exact number of stowed and extended configurations depends on the particular multitool design and on the number of separate wrenches used, the number of additional tools used, the number of hinge joints, the range of motion of these hinge joints, and the arrangement of the hinge joints on the multitool.

The disclosed folding pliers can be used with other folding tool designs similar to those seen in the prior art to make a compact pocket-ready tool. Besides the folding hinges that fold the pliers into a stowed position, each wrench head and/or socket can comprise a pivotal hinge near the wrench head or socket so that the wrench head and socket can be angled with respect to its tool arm (folding handle). Both the folding handle hinge(s) and the multisocket pivotal hinges can include a stabilizing means that provide sufficient friction and/or a controllable locking action in the hinge joint so that the plier handles can hold a particular angle during use. The stabilizing means can comprise any of a number of standard holding and/or locking devices that are common to wrenches, such as, a multiple stable position hinge system (see holding assembly 47*b* in FIG. 2A), a smooth friction hinge mechanism (see friction spring disks 81*c* and 82*c* in FIGS. 4A-C) and/or locking or latching hinge mechanisms (see locking mechanisms 81*b* and 82*b* in FIGS. 4A-C). Of course other locking and friction based stabilizing means can be used with the folding hinges and pivot hinges disclosed in this patent. The term "folding hinge" is used within this patent to identify a hinge that is used to fold and/or extend the plier's handles or arms, as opposed to other hinges like wrench head pivot hinge pins 37*a* and 37*b* which are used to pivot duplex wrench heads 31 & 33, and 32 & 34, respectively, and like socket pivot hinge pin 47*a* which is used to pivot ratchet wrench head 49. Because of the similarity between the definitions of the words "pivoting" and "folding", the terms "pivoting" and "pivotal" will sometimes be used when discussing "folding hinges" and the term "folding" at times used when discussing pivotal tool head hinges and pivot pins.

All hinges can comprise a friction means and/or locking mechanism to help hold the tool arms and/or head at a particular angle with respect to the rest of the multitool. These friction and locking means can comprise any standard system used with hinges to help hold a tool arm in place during use. Several examples of friction creating and locking systems are shown in this patent, and many others can be used.

Figure 6A:
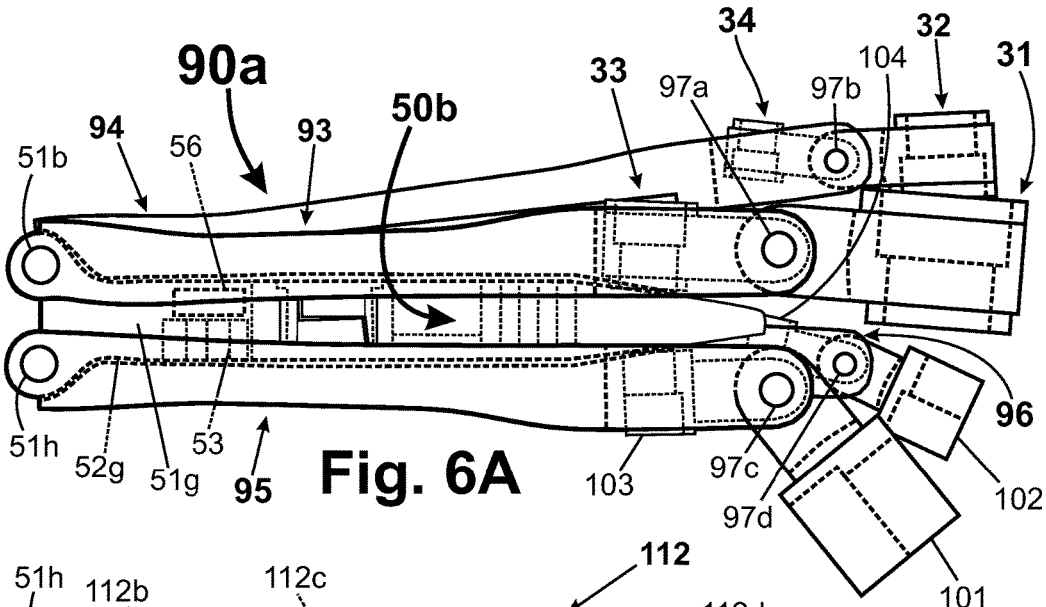

The disclosed invention comprises a pliers (needle nose pliers, channel lock pliers, adjustable pliers, etc.) and a full set of folding wrenches and/or socket sizes combined into a single multitool. This can significantly reduce the overall stowed size of the multitool. In many cases, this means the multitool handles are approximately half the length of the multitool when extended. In some configurations the tool handles can have different lengths to allow the wrench heads to store adjacent, and/or nest next to each other near the front end of the pliers. Similarly, these folding pliers designs can pivot the tool handles to the side of the pliers with a folding hinge axis that is substantially perpendicular to the axis of the pliers claw hinge 57. These perpendicular folding hinges can provide one or more tool handles on each plier arm. In FIG. 6A the disclosed multitool provides two folding hinges on each plier arm. Each of these folding hinges may include a friction mechanism and/or a locking mechanism to stabilize and/or hold the arms in a particular configuration during use. The prior art shows many friction and locking mechanisms that are commonly used with wrenches, ratchets, and other hand tools similar to the disclosed folding multitool. Both friction and locking mechanism examples are shown in this patent, but these example designs are only a small sampling of the many types of motion stabilizing mechanisms (friction, locking, etc.) for hinges and pivots that are presently designed for hand tools. Nearly all prior art hinge stabilizing mechanisms designed for hand tools can be easily made to work on the disclosed folding multitool.

Most combination of multisocket styles, folding hinge types, wrench gripping surfaces, and wrench head types can be used to combined with various types of folding pliers using the disclosed technology. For example, a specialty pliers can be combined with standard box-end or open end wrench heads to provide four gripping surfaces if substituted on folding pliers multitool 90, up to six gripping surfaces if substituted on folding pliers multitool 70, up to eight gripping surfaces if substituted onto four handle pliers 90*a*, and up to twelve gripping surfaces if handles with three wrench head (see pliers multitool 70) are substituted onto four handle pliers 90*a*. Alternatively, a specialty pliers can be combined with overlapped duplex box-end wrench heads to provide sixteen gripping surfaces if substituted on pliers 90, up to twenty-four gripping surfaces if substituted on folding pliers 70, up to thirty-two gripping surfaces if substituted onto four handle pliers 90*a*, and up to forty-eight gripping surfaces if handles with three wrench head (see pliers 70) are substituted onto four handle pliers 90*a*. Other specialty gripping surfaces and/or wrench head types can be substituted as desired. In most situations such large numbers of gripping surfaces are not needed and other handles can be used for other tools. In this way a highly functional tool for a specific industry can be realized. For example, a specialty pliers can be combined with a wrench set and other specialty tools to the multitool to provide the tools needed for a specific automobile brand (e.g., specific wrench and/or socket sizes, ratchet wrenches, specific screwdrivers, grommet removers, specialty wrenches for rotatory fasteners on that particular brand of automobile, retaining ring pliers, brake spring remover tool, etc.). Other professions might want a completely different collection of tools (e.g., screwdriver set, allen wrench set, hammer, etc. for general workers; diagonal cutters, cable cutters, lineman pliers, phillips screwdrivers, square-recess screwdrivers, cabinet tip screwdrivers, wire strippers, wire benders, etc. for electrical journeyman, and other tools for other professions). Thus, a specialty wrench set and other tools can be combined with a specific pliers head to form the desired multitool. In this way, a highly functional tool can be designed for a specific industry (e.g., a wrench set designed for a specific automobile). Similarly, other tools can be combined with the wrench and socket sets to provide a very versatile multitool (e.g. adding a screwdriver and/or allen wrenches to the multitool, see FIG. 6B).

OBJECTIVES AND ADVANTAGES

Accordingly, many unique structures and advantages of my invention are:

a) To provide a folding pliers multitool that combines a pliers with a full set of wrenches (pliers and full wrench set).

b) To provide a folding pliers multitool that combines a pliers with a full set of wrenches.

Where the handles for the pliers can fold adjacent the pliers' head for stowage.

c) To provide a folding pliers multitool with three, four, and/or more folding handles, wherein each folding handle comprises at least one or more hand tools.

d) To provide a folding pliers multitool that combines a pliers with a full set of wrenches. Where the handles for the pliers can fold along a handle hinge axis substantially parallel to the pliers' hinge axis and adjacent the pliers' head for stowage (see FIGS. 3A through 4C).

e) To provide a folding pliers multitool that combines a pliers with a full set of wrenches. Where the handles for the pliers can fold along a handle hinge axis substantially perpendicular to the pliers' hinge axis and adjacent the pliers' head for stowage (see FIGS. 5A through 6C).

f) To provide a folding pliers multitool that combines a pliers with a full set of wrenches. Where the full set of wrench is defined by at least one folding handle pivotally mounted on each of the two arms of the pliers.

g) To provide a folding pliers multitool that combines a pliers with a full wrench set. Where the full wrench set comprises at least four, five, six, seven, eight, nine, ten, eleven, and/or twelve rotary fastener gripping surface sizes.

h) To provide a folding pliers multitool that combines a pliers with a full wrench set. Where the full wrench set comprises at least four, five, six, seven, eight, nine, ten, eleven, and/or twelve rotary fastener gripping surface sizes. And further including one or more additional hand tool(s) that are commonly combined with pliers in the prior art (e.g. a screwdrivers, allen wrenches, knives, hammers, scissors, pry tool, flashlights, bottle openers, can openers, files, various fishing tools, etc.).

i) To provide a folding pliers multitool that combines a pliers with a full wrench set. Where the full wrench set is defined by at least four, five, six, seven, eight, nine, ten, eleven, and/or twelve wrench and/or socket gripping surface sizes.

j) To provide a folding pliers multitool that combines a pliers with a full wrench set. Where the full wrench set is defined by two or more double nested duplex wrench ends (eight or more gripping surface sizes).

k) To provide a folding pliers multitool that combines a pliers with a full wrench set. Where the full wrench set is defined by two or more Figure-eight® wrench ends (eight or more gripping surface sizes).

l) To provide a folding pliers multitool that combines a pliers with a full wrench set. Where the full wrench set is defined by two or more multi-sized sockets (multi-pin sockets, multi-sleeve sockets, etc.).

m) To provide a folding pliers multitool that combines a pliers with a full wrench set. Where the handles for the pliers can fold adjacent the pliers' head for stowage. Where the full wrench set is defined by two or more double nested duplex wrench ends (eight or more gripping surface sizes).

n) To provide a folding pliers multitool that combines a pliers with a full wrench set. Where the handles for the pliers can fold adjacent the pliers' head for stowage. Where the full wrench set is defined by two or more Figure-eight® wrench ends (eight or more gripping surface sizes).

o) To provide a folding pliers multitool that combines a pliers with a full wrench set. Where the full wrench set is defined by two or more multi-sized sockets (multi-pin sockets, multi-sleeve sockets, etc.). Where the multi-sized sockets can fold adjacent the pliers' head for stowage.

p) Where the folding pliers multitool in items f) through o), further including one or more additional hand tool(s) that are combined with pliers in the prior art (e.g. a screwdrivers, allen wrenches, knives, hammers, scissors, pry tool, flashlights, bottle openers, can openers, files, various fishing tools, etc.).

q) The folding pliers multitool in items f) through p), wherein the handles for the pliers can fold along a handle hinge axis substantially parallel to the pliers' claw hinge axis and can fold adjacent to the pliers' head for stowage (see FIGS. 3A through 4C).

r) The folding pliers multitool in items f) through p), wherein the handles for the pliers can fold along a handle hinge axis substantially perpendicular to the pliers' claw hinge axis and can fold adjacent to the pliers' head for stowage (see FIGS. 5A through 6C).

s) To provide a folding pliers multitool that combines a pliers with a full set of wrenches. Where each arm of the pliers defines two folding handles so that each pliers arm can pivotally connect two separate handles (total of four handles, see discussion of FIG. 5B).

t) To provide a folding pliers multitool that combines a pliers with a full set of wrenches. Where each arm of the pliers defines two folding hinges so that each pliers arm can pivotally connect two separate handles (total of four handles, see FIG. 6A).

u) Where the folding pliers multitool in items s) and t), further including one or more additional hand tool(s) that are combined with pliers in the prior art (e.g., screwdrivers, allen wrenches, knives, hammers, scissors, pry tool, flashlights, bottle openers, can openers, files, various fishing tools, etc.).

v) To provide a folding pliers multitool with one, two, and/or more tool handles with two or more rotary fastener gripping surface sizes, and comprising one or more tool handles with a tool other than a wrench or socket tool.

w) To provide a folding pliers multitool with one, two, and/or more tool handles with three or more gripping surface sizes, and further comprising one or more tool handles with a tool other than a wrench or socket tool.

x) To provide a folding pliers multitool with one, two, and/or more tool handles with four or more rotary fastener gripping surface sizes, and comprising at least one tool handle supporting a tool other than a wrench or socket tool, such as, screwdriver, knife, hammer, pry bar, pliers, ratchet head, etc.

DRAWING FIGURES

FIG. 1A Prior Art—Duplex wrench head

FIG. 1B Prior Art—Figure-Eight® wrench head with two pivotal duplex wrench heads.

FIG. 1C Prior Art—Double Nested wrench head with two pivotal duplex wrench heads.

FIG. 1D Prior Art—Overlapped Duplex wrench head

FIG. 2A Prior Art—Multi-sized socket with ratchet wrench

FIG. 2B Prior Art—Folding needle nose pliers

FIG. 2C First Embodiment—Folding Pliers wrench 64 (Perspective view) with two overlapped duplex wrench heads (eight wrench gripping surface sizes).

FIG. 3A Second Embodiment—Folding Pliers 70 (Side view) with two double nested wrench heads seen in stowed position. (Four to twelve sizes).

Figure 3B:
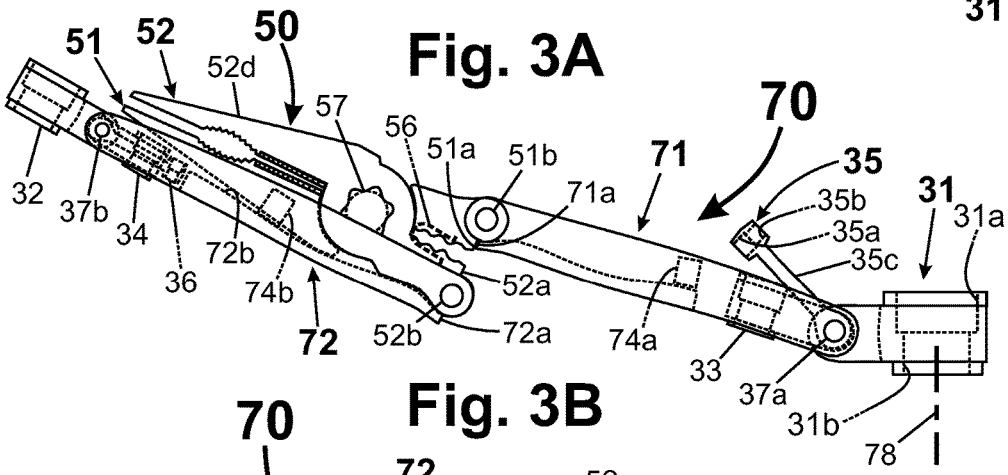

FIG. 3B Folding Pliers 70 (Side view) with handle extended for use of wrench head.

Figure 3C:
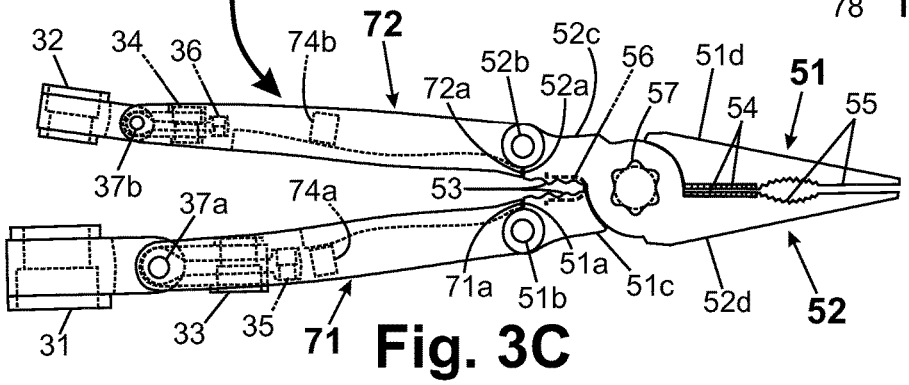

FIG. 3C Folding Pliers 70 (Side view) with both handles extended for use of pliers.

Figure 4A:
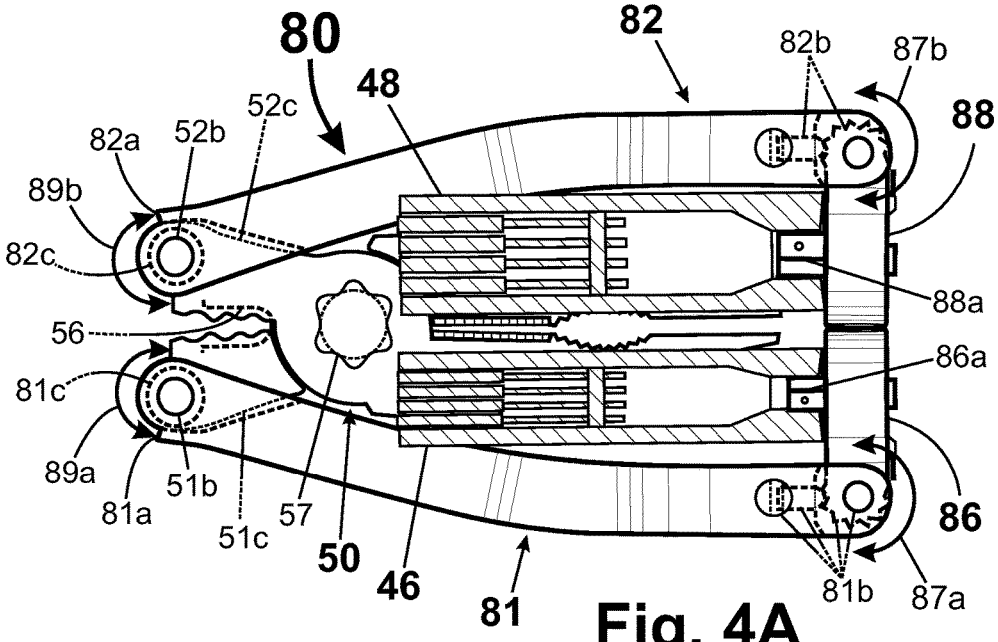

FIG. 4A Third Embodiment—Folding Pliers 80 (Side view) with two multi-sized sockets on ⅜ inch and ½ inch ratchet drives.

Figure 4B:
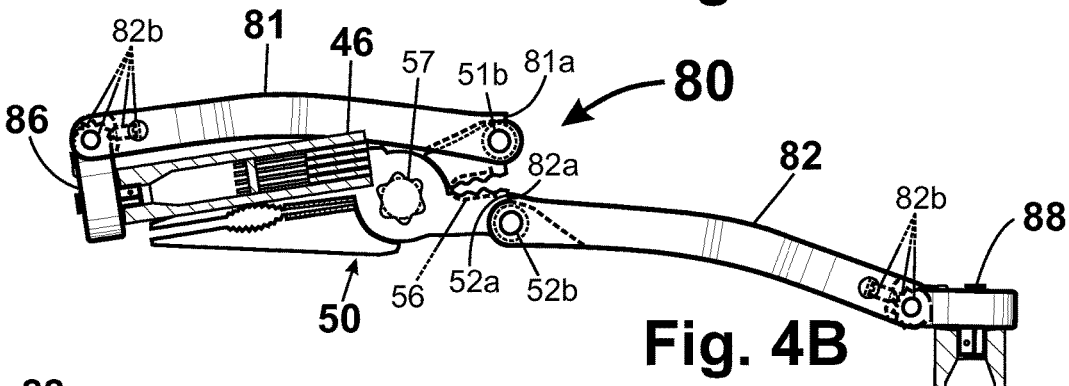

FIG. 4B Folding Pliers 80 (Side view) with handle extended for use of ratchet wrench.

Figure 4C:
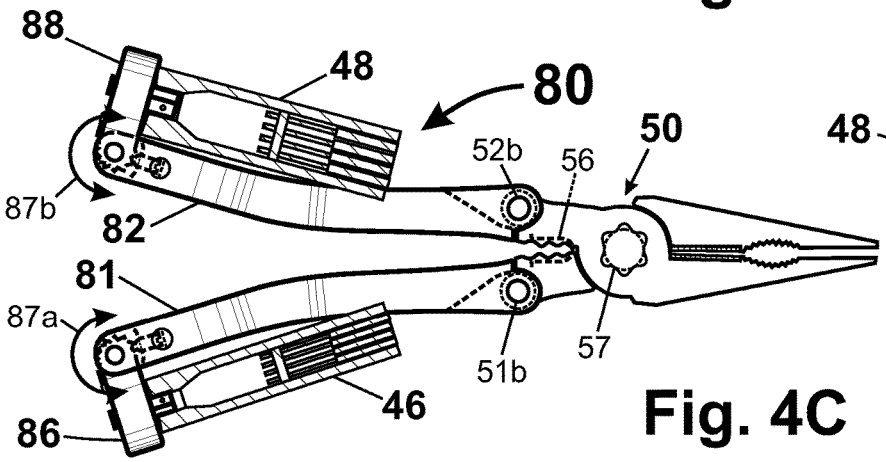

FIG. 4C Folding Pliers 80 (Side view) with both handles extended for use of pliers.

FIG. 5A Fourth Embodiment—Folding Pliers 90 (Side view) with two double nested duplex wrench heads (eight gripping surface sizes) near its fully stowed position.

FIG. 5B Folding Pliers 90 (top view) with both handles in their fully stowed position.

FIG. 5C Folding Pliers 90 (Side view) with both handles extended for use of pliers.

FIG. 6A Fifth Embodiment—Folding Pliers 90*a* (Side view) with four handles each with a double nested duplex wrench head (sixteen gripping surface sizes) near its fully stowed position.

Figure 6B:
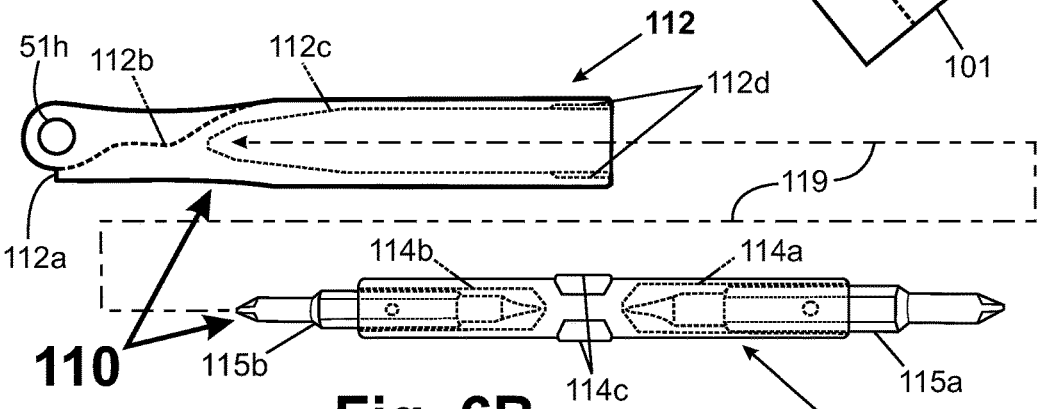

FIG. 6B Alternative tool assembly 110 for folding pliers 90*a*, with reversible screwdriver.

Figure 6C:
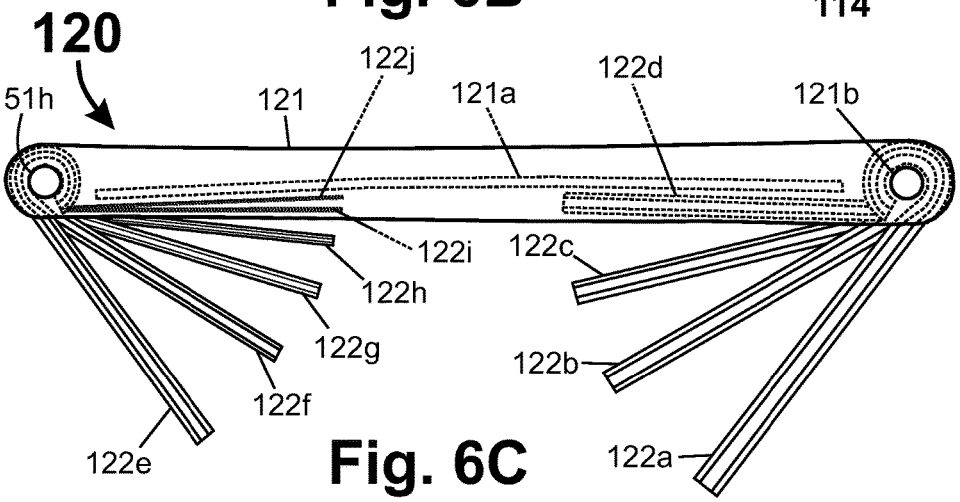

FIG. 6C Alternative tool handle 120 for folding pliers 90*a*, with Allen wrench set.

FIG. 7A Sixth Embodiment—Folding Pliers 130 (Top view) with eight wrench handles each with a single size wrench head near its fully stowed position.

FIG. 7B Folding Pliers 130 (Side view) with handles in their fully stowed position.

FIGS. 8A-B Compound folding pliers 150 (top and side views, respectively).

DEFINITIONS

PIVOT and PIVOTAL—For this patent "pivot" and "pivotal" will most often be used to refer to the ability to change the orientation of a double ended socket with respect to its tool arm. The terms can also be used to refer to the pivoting of one tool arm with respect to another tool arm and/or a hub.

SUBSTANTIALLY PARALLEL—Within twenty degrees of being exactly parallel.

SUBSTANTIALLY PERPENDICULAR—Within twenty degrees of being exactly perpendicular.

FOLDING HINGE—A hinge that is used to fold and extend a tool handle.

LONGITUDINALLY ADJACENT—where two or more elongated objects (e.g. tool arms, sockets, screwdrivers, pliers head assembly, etc.) are brought lengthwise adjacent one another and their longitudinal axes are substantially parallel to a central axis (midpoint of axes) of the collection of elongated objects.

FULL SIZED WRENCH HEADS—A wrench head with a "wrench head height" that is equal to or greater than one-third (33%) of the "effective fastener size" for that wrench head's gripping surface. The "wrench head height" is measured along the rotational axis of the wrench head's gripping surface from the front edge of the wrench head to the back edge. For a duplex wrench head, the "wrench head height" can be measured from the beginning of one gripping surface (near the center of the wrench head) to the outside edge of the duplex wrench (approximately one-half the overall height of a duplex wrench head, but depends on the actual gripping surface sizes on the duplex wrench head). The "effective fastener size" can be the stated size for the wrench which is approximately the distance measured from surface to surface across a similarly stated size fastener. Thin stamped metal wrenches with thicknesses less than approximately one-third (33%) their stated gripping surface size are inferior to a full sized wrench both in strength and ease of use. Full sized wrenches are normally manufactured using a drop forge process and/or a machining process. Thinner wrenches are often die cut to shape.

FULL SET OF WRENCHES (Full Wrench Set)—A set of wrench(es) and/or socket(s) that provide a full set of wrench and/or socket sizes needed for a particular use. Wherein the number of gripping surface sizes incorporated into the multitool is sufficient for working in a specific environment, industry, application, or for a specific user. For example, a bicycle pliers wrench set might comprise a "full wrench set" requiring only three different wrench gripping surface sizes plus other tools for working on bicycles, while an automotive pliers wrench set might require eight or more wrench and/or socket sizes to provide a full wrench set, and if both metric and standard gripping surfaces are require a "full wrench set" might have twelve or more different gripping surface sizes.

PLIERS—A tool with two arms pivotally attached between their ends and forming jaws at one end and handles or arms on the other end. Many different pliers types fit under this definition, such as, needle-nose pliers, combination pliers, cutting pliers, locking pliers, linesmen's pliers, punch pliers, slip-joint pliers, three-prong pliers, compound pliers and other specialty pliers.

DETAILED DESCRIPTION OF THE INVENTION

All of the folding pliers (multitool) disclosed in this patent would generally be made of a hardened metal or metal alloy such as high carbon steel, chrome vanadium steel, stainless steel, titanium, aluminum alloy, nickel alloys, cobalt alloys, etc. The materials used to make the disclosed multitool are not limited to metals, and other materials like plastics and composite materials can be used depending on the tool needs. The standard manufacturing methods of drop forging and machining, injection molding, extrusion, laminating, etc., can be used here to manufacture the disclosed multitool. The use of press fitted hinge pins and pivot pins and/or screwed in hinge pines and pivot pins can provide assembly that is typical of existing wrenches and tools. Chrome vanadium steel is popular for wrenches, ratchets, hammers, screwdrivers, and other hand tools because of its combination of relatively inexpensive cost, high strength, and good corrosion resistance. Standard tool manufacturing techniques can be used to construct the disclosed wrenches and other tools. Hinge construction on these multitools can comprise nearly any hinge structure that can support the torques and loads that will be applied perpendicular to the hinge axis during use. The folding hinges' axis can be oriented substantially perpendicular to the wrench and socket tools' gripping surface axes so that the pivot hinges do not need a locking mechanism in order for the user to transfer torque through the hinge to a rotary fastener. This means that when turning a vertical axis fastener the wrenches' pivot hinge(s) are oriented substantially parallel to the horizontal plane that is normal (perpendicular along two axes) to the fastener's turning axis. A locking mechanism can be used on the folding hinges and/or pivot hinges to prevent pivoting of the hinges during use, and any of the multitude of existing hinge locking methods can be used.

The relationship between the axis of a rotary fastener and the axis of the wrench head's gripping surface is that when the wrench's gripping surface is engaged with a rotary fastener the axis of the gripping surface will point substantially in the same direction as the axis of the rotary fastener. This means that the turning axis of a bolt or nut is substantially parallel and aligned with the axis of that gripping surface. In the presented designs, the axis of the gripping surfaces can also be substantially perpendicular to the pivoted axis of the tool handle's folding hinge. This arrangement not only provides the ability to transfer torque from one end of the multitool to the other without a locking mechanism, but it can also allow for a vertically compact hinge arrangement.

In the discussion of these folding pliers multitools, the geometry of the tool heads and hinges are critical. Some of the wrench head gripping surfaces discussed in this patent are angled at approximately fifteen degrees away from perpendicular with its tool handle (see FIG. 2C). For a rotary fastener with its axis angled vertically the tool handle can be angled upward and away from the horizontal plane that is normal (perpendicular along independent two axes) to the axis of the rotary fastener and thus provide space for the user's fingers between the tool arm and the horizontal surface (which often involves a real surface). Many of the wrench heads disclosed in this patent can have this approximately fifteen degree angle, though other angles can be used. However, as this upward angle becomes greater than thirty degrees the wrench starts to become less stable, and/or begins to operate more like a screwdriver than a wrench. These larger angles can also reduce the amount of torque that can be applied to the rotary fastener. The double nested duplex wrench ends shown in this patent can allow gripping surface angles over a range of more than one-hundred eighty degrees so that the rotational axis of the gripping surfaces can be adjusted from parallel to perpendicular with the longitudinal axis of the wrench head's pivot arm. The short length of these pivot arms allow the wrench heads and handle to operate similar to a single size wrench with an adjustable angle wrench head. Thus, each gripping surface on a double nested duplex wrench can be angled to substantially all the useful orientations for the gripping surfaces.

The disclosed double nested wrenches can be designed specifically for used in a folded handle configuration so that each handle can be used in seven different configurations: 1) a screwdriver handle position (gripping surface axis substantially parallel to the handles), 2) a short handle position (handles folded next to pliers), 3) a crank handle position (gripping surface axis substantially parallel to the wrench handle being used as the crank handle), 4) a long handle position (handle unfolded to provide an extended handle), 5) an extra long handle position (for socket is extended along with its handle), 6) a pliers handle position (arms folded out to be used as plier handles), and 7) a stowed position (both handles folded adjacent pliers' body). Each positional configuration has its own advantages during actual operation.

In FIGS. 1A-D, four examples are given for different wrench head types and styles that can be used with the disclosed folding pliers multitool. These examples are only a small selection from the many styles and types of wrenches that can be use. In fact, any style and/or type of wrench head can be used with the disclosed folding pliers multitool with only minor adjustments. However, wrench heads with two or more gripping surface sizes are preferred because a full set of wrenches can be added to a pliers in a more compact format than if single-size wrench heads are used (see FIGS. 7A-B).

In FIG. 1A, we see a sectioned perspective view of a box-end duplex wrench 20 with two six-point lobe gripping surfaces 21 and 22. Gripping surfaces 21 and 22 are separated by a divider flange 24 and connected to handle 23. Gripping surfaces 21 and 22 can be two different sizes of gripping surfaces as shown, with surface 21 for larger sized rotary fasteners and surface 22 for smaller rotary fasteners. Notice the small forward slant of gripping surfaces 21 and 22 away from handle 23. This forward slant is often set at fifteen degrees from perpendicular with the longitudinal axis of handle 23 to allow more ergonomic operation by the user.

In FIG. 1B, we see a front view of a Figure-Eight® wrench end 25, comprising two duplexed wrench heads 20*a* and 20*b* mounted pivotally on a pivot pin 26, and a hinge paw 29. Duplex wrench head 20*a* comprises a pair of twelve-point spline gripping surfaces 21*a* and 22*a*, and a pivot arm 23*a*. Duplex wrench head 20*b* comprises a pair of twelve-point spline gripping surfaces 21*b* and 22*b*, and a pivot arm 23*b*. Both duplex wrench heads 20*a-b* are designed to be able to rotate through hinge paw gap 27 (between hinge paw arms 29) so that both wrench heads can pivot three-hundred sixty degrees in either direction. However, wrench heads 20*a* and 20*b* cannot pivot past each other. This design requires the exterior width of hinge paw 29 to be significantly greater than the width of the larger wrench head 20*a*.

In FIG. 1C, we see a front view of the Applicant's improvement to the Figure-Eight® wrench end seen in FIG. 1B. The double nested wrench head 30 shown in FIG. 1C, comprises three separate duplex wrench heads 31, 33, and 35, a pivot pin 37*a*, a hinge paw 39 on handle 38. Duplex wrench head 31 comprises a pair of six-point (hex) gripping surfaces 31*a* and 31*b*, and hinge paw arms 31*c*. Duplex wrench head 33 comprises a pair of six-point gripping surfaces 33*a* and 33*b*, and pivot arm 33*c*. Duplex wrench head 35 comprises a pair of six-point gripping surfaces 35*a* and 35*b*, and curved pivot arm 35*c*. All of these gripping surfaces can use alternative gripping surface types, such as twelve-point spline, six-point lobe, twelve-point standard, etc. Pivot pin 37*a* pivotally attaches wrench heads 31, 33 and 35 to hinge paw 39 on handle 38. The double nested wrench is formed by having wrench head 31 nested inside hinge paw 39, and wrench head 33 nested inside hinge paw 31*c* of wrench head 31. Thus, there is a double nesting of wrench heads 31 and 33 inside hinge paw 39 to form a double nested wrench head. Wrench head 35 is optional in this double nested wrench head design. Finally, because at least one of wrench heads 31, 33 and 35 is a duplexed wrench head (actually all three are duplex wrench heads), double nested wrench head 30 can be referred to as a "double nested duplex wrench head".

In FIG. 1C, the gripping surface sizes for each wrench head 31, 33 and 35 skip two sizes between each wrench head. This skipping of sizes allow hinge paw 39 to be made much narrower because only the much smaller wrench heads 33 and 35 must pivot through the hinge paw. This allows the exterior width of hinge paw 39 to be narrower than the width of the largest duplex wrench head 31. As we will see in FIGS. 3A-C, the skipped wrench head sizes on wrench heads 32, 34, and 36 will be added to a similar wrench handle to form a full twelve-sized wrench set. By separating the wrench head sizes like this, hinge paw 39 can be made significantly narrower than with the Figure-Eight® wrench design (see FIG. 1B). In fact, the double nested hinge paw 39 is significantly narrower than Figure-Eight® hinge paw 29 even though wrench head 31 has gripping surfaces that are more than fifty percent large than Figure-Eight® wrench head 20*a*. Double nested wrench heads 31, 33, and 35 can be pivoted to several useful positions similar to the way the Figure-Eight® wrench can be used, but the largest wrench head 31 is limited in its range of rotation because of the narrower dimensions of hinge paw 39. However, this limitation in rotation does not significantly effect its usefulness since the wrench heads can be pivoted to all normally used angles.

In FIG. 1D, we see a perspective view of an overlapped duplex wrench head 40 comprising a handle 44 and four gripping surfaces 41*a*, 41*b*, 42*a*, and 42*b* mounted on the end of the handle. An optional divider ridge 43 is provided to make the use of the gripping surfaces more ergonomic. The axis for gripping surfaces 41*a-b* can be parallel to the axis of gripping surfaces 42*a-b*, or can be angled as shown. A common angle for the axis of the gripping surfaces is fifteen degrees from perpendicular with the handle, which would angle the axis of gripping surfaces 41*a-b* thirty degrees away from the axis of gripping surfaces 42*a-b*.

In FIG. 2A, we see a side view of a prior art ratchet wrench assembly 45 comprising, a handle 47, a hinge pin 47*a*, a locking mechanism 47*b*, a reversible ratchet head 49, and a section side view of a multi-pin multisocket 46. Multisocket 46 comprises a plurality of spring loaded pins that can conform to different sized fasteners for use. Ratchet head 49 comprises a ⅜ inch socket connector 49*a* and a ratchet direction selector 49*b*. Multisocket 46 is removably connected to socket connector 49*a* for use. Multisockets with spring loaded pins like multisocket 46 are presently more common than sleeve-type multisockets (sleeves instead of pins). Sleeve type multisockets can have spring-loaded or user selected sleeves to allow use with a wide variety of rotary fastener sizes. All three types of multisockets can easily be used with ratchet head 49 and handle 47 as shown. The prior art shows many types of multisockets which can be designed to work with a variety of different ratchet heads types, and incorporated into the disclosed folding pliers multitools.

In FIG. 2B, we see a side view of a prior art folding pliers multitool 60 comprising a pliers assembly 50, and two pivot handles 61 and 62 pivotally connected to pliers assembly 50 with hinge pins 51*b* and 52*b*, respectively. Pliers assembly 50 comprises two matching plier portions 51 and 52 (two plier sections) which are pivotally connected to each other with pliers claw hinge 57 and are biased to open by spring clip 56. In alternate designs, spring clip 56 can be replaced with a torsion spring, or a compression spring, both of which are commonly used to bias pliers assemblies. Pliers section 51 comprises plier arm 52*c* with a pivot stop 52*a* and hinge pin 52*b*, and a claw portion 52*d*. Pliers section 52 comprises plier arm 51*c* with a pivot stop 51*a* and hinge pin Sib, and a claw arm 51*d*. In this particular design, plier claw portions 51*d* and 52*d* comprise a cutting pliers tool 54 and a needle-nose pliers tool 55, while plier arms 51*c* and 52*c* comprise a crimping and wire striping tool 53. Notice that plier arms 51*c* and 52*c* are shortened so that handles 61 and 62 can be folded to a compact stowed position next to (adjacent) pliers assembly 50. Tool handle 61 comprises a pivot stop 61*a*, a body channel 61*b*, a pivot pin 61*c*, and a fold out screw-driver 63*a*. Handle 62 comprises a pivot stop 62*a*, a body channel 62*b*, a pivot pin 62*c*, and a fold out knife 63*b*. Tools 63*a-b* are shown here only as an example, and additional tools on handles 61 and 62 are common. Body channels 61*b* and 62*b* on handles 61 and 62 respectively, are designed to fold over pliers assembly 50 as shown (see stowed handle positions 61*z* and 62*z*). To hold pliers multitool 60 in this stowed position against the biasing of spring clip 56 a significant amount of friction is often built into hinges 51*b* and 52*b* to hold plier sections 51 and 52 together in the stowed position.

In FIG. 2C, we see the first embodiment of a folding pliers multitool 64 in perspective view, comprising pliers assembly 50 and two folding tool handles 65 and 66 each with attached overlapped duplex wrench heads 67 and 68, respectively. Pliers assembly 50 can be the same design seen in FIG. 2B, or be any other pliers design with appropriate length plier arms (see plier arms 51*c* and 52*c*) and pivot stops (see stops 51*a* and 52*a*). Pliers assembly 50 is shown here as a somewhat customized pliers with the understanding that nearly any type or style of pliers can be used in place of pliers 50 on any of the disclosed folding pliers multitools. Tool handle 65 comprises a handle body 65*b* with a pivot stop 65*a* on one end and an overlapped duplex wrench head 67 on the other end. Tool handle 66 comprises a handle body 66*b* with a pivot stop 66*a* on one end and an overlapped duplex wrench head 68 on the other end. Overlapped duplex wrench head 67 comprises four gripping surfaces 67*a*, 67*b*, 67*c*, and 67*d* arranged in a duplexed arrangement of overlapped gripping surfaces. Overlapped Duplex wrench head 68 similarly comprises four gripping surfaces, but only the two larger overlapped griping surfaces 68*a*, and 68*b* are labeled to keep the drawing from being too cluttered. In this particular design, wrench head 67 contains the four largest gripping surface sizes, while wrench head 68 holds the four smallest gripping surface sizes. In alternate designs this arrangement can be changed. Also, the gripping surfaces on wrench heads 67 and 68 are angled at approximately fifteen degrees away from perpendicular to the handles to provide a more ergonomic use of the wrench heads. In alternate designs, the gripping surfaces' axis can be perpendicular to the handles for a more compact stowed position. In alternate designs, the larger gripping surfaces 67*a-b* and 68*a-b* do not need to be arranged facing outward as shown in their stowed position (see FIG. 2C), but can easily be made to face inward so that the smaller gripping surfaces face outward when stowed.

In FIG. 2C, wrench handles 65 and 66 can be pivoted out individually for use as indicated by range of motions 69*a* and 69*b* for each handle respectively. With handle 65 pivoted away from pliers assembly 50, wrench gripping surfaces 67*a-d* can be used to turn rotary fasteners of appropriate size, with handle 66 and pliers assembly 50 being used as the wrenches' handle. With handle 66 pivoted away from pliers assembly 50, the wrench gripping surfaces on wrench head 68 can be used to turn rotary fasteners, with handle 66 and pliers assembly 50 being used as the handle for these wrenches. With both handles 65 and 66 pivoted fully to the left in FIG. 2C, (pivot stops 65*a* and 66*a* on handles 65 and 66, making contact with pivot stops 51*a* and 52*a* on arms 51*c* and 52*c*, respectively) handles 65 and 66 can be used as the handles for pliers assembly 50.

In FIG. 3A, we see a second embodiment of a folding pliers multitool 70 in side view, comprising pliers assembly 50, folding tool handles 71 and 72 attached a hinge pins 51*b* and 52*b*, respectively, a pivot pin 37*a* for pivotally attaching three wrench heads 31, 33 and 35, and a pivot pin 37*b* for pivotally attaching three wrench heads 32, 34, and 36. Pliers assembly 50 can be the same as pliers 50 seen in FIGS. 2B and 2C, or comprise any pliers designs that has been sized for use with folding handles 71 and 72. Folding tool handle 71 comprises a pivot stop 71*a*, a U-shaped channel body 71*b*, a pair of hinge paw arms 71*c* and a friction spring clip 74*a*. Folding tool handle 72 comprises a pivot stop 72*a*, a U-shaped channel body 72*b*, a pair of hinge paw arms 72*c*, and a friction spring clip 74*b*. Friction spring clips 74*a-b* can fit into slots on the inside of channel bodies 71*b* and 72*b*, respectively, and can be designed to grip pliers sections 52 and 51, respectively when in the stowed position (shown in FIG. 3A). Spring clips 74*a-b* can provide the needed holding friction to keep pliers multitool 70 in its stowed position (see FIG. 3A) against the biasing of spring clip 56. Duplex wrench heads 31 through 36 are labeled from largest to smallest, respectively, each with two gripping surface sizes and a pivot arm(s). Wrench head 31 comprises gripping surfaces 31*a-b*, and a pair of pivot paw arms 31*c*. Wrench head 32 comprises gripping surfaces 32*a-b*, and a pair of pivot paw arms 32*c*. Wrench head 33 comprises gripping surfaces 33*a-b*, and pivot arm 33*c*. Wrench head 34 comprises gripping surfaces 34*a-b*, and pivot arm 34*c*. Wrench head 35 comprises gripping surfaces 35*a-b*, and pivot arm 35*c*. Wrench head 36 comprises gripping surfaces 36*a-b*, and pivot arm 36*c*. This arrangement of hinge paw arms 71*c* and pivot pin 37*a* connecting wrench heads 31, 33, and 35 to handle 71 can be substantially the same structure as seen in FIG. 1C, with hinge paw arms 39 and pivot pin 37*a* connecting wrench heads 31, 33, and 35 to handle 38.

In FIG. 3A, folding pliers multitool 70 is shown substantially in its folded and stowed position. Wrench head 36 is pivoted away from pliers assembly 50 to provide room for labeling its components, but can be pivoted counter-clockwise against the claw portion 51*d* of pliers 50 to provide a fully stowed position. U-shaped channel bodies 71*b* and 72*b* are designed to accept the sides of pliers 50 into the channel bodies for a more compact stowed position. U-shaped channels 71*b* and 72*b* can be designed to snugly fit over pliers assembly 50, or alternately can use friction spring clips 74*a-b* to hold handles 71 and 72 in place over pliers 50. Ideally channels 71*b* and 72*b* have enough flex to provide a strong holding force against pliers assembly 50 without the need for friction spring clips 74*a-b*. With a very snug fit the handles 71 and 72 can easily grip the pliers section it surrounds (stowed position). This allows sideways directed forces to be transferred from the handle to its respective pliers section. For example, U-shaped channel body 72*b* can fit snugly around the claw portion 51*d* of pliers section 51 so that torque can be transferred from handle 72 to pliers section 51 and then to handle 71 and its wrench heads 31, 33 and 35 (see FIG. 3B) without slipping. Similarly, channel body 71*b* can fit snugly around the claw portion of the claw portion 52*d* of pliers section 52 so that torque can be transferred from handle 71 to pliers section 52 and then to handle 72 and its wrench heads 32, 34, and 36. If handles 71 and 72 do not grip plier sections 52 and 51, respectively, then during use, torque would be transferred through pliers hinge 57 instead of directly through one of the plier sections 51 and 52. Pliers hinge 57 represents a less durable component for transferring torque, so channel shaped handles 71 and 72 which can grip the plier sections 52 and 51, respectively, is preferred.

In FIG. 3B, we see a side view of folding pliers multitool 70 with handle 71 extended for use. In this position, wrench head 31 is ready to use gripping surface 31*b* to turn a rotary fastener around rotational axis 78. Wrench heads 33 and 35 can alternately be pivoted out to the position of wrench head 31 for use, while the other wrench heads are pivoted out of the way. Handle 72 is folded against plier section 51 and can be held in place by a snug fit between channel 72*b* and plier section 51, or from friction generated by spring clip 74*b*, or other holding or locking method. With handle 72 folded over plier section 51 a force applied to handle 72 can be transferred to plier section 51 which is directly connected to handle 71 through hinge pin Sib. This can allow a side force applied to handle 72 to be transferred through pliers assembly 50 without placing undue off-axis torque on pliers claw hinge 57. Thus, handle 72 and plier section 51 act like a single wrench handle to apply torque to hinge pin 51*b* and then handle 71. Reversing the positions of handles 71 and 72 allows handle 71 and plier section 52 to act as a handle for applying torque to hinge pin 52*b* and handle 72.

In FIG. 3C, we see a side view of folding pliers multitool 70 with both handles 71 and 72 extended for use in its pliers configuration. With both handles extended as shown, pivot stops 71*a* and 72*a* are forced against pivot stops 51*a* and 52*a*, respectively so that handles 71 and 72 can be used to apply pressure to pliers tools 53, 54, and 55. Spring clip 56 provides a restoring force on plier sections 51 and 52 so that the pliers open automatically when the user releases pressure on handles 71 and 72. Handles 71 and 72 can be shaped and contoured to provide an ergonomic grip for the user as desired.

In FIG. 4A, we see a third embodiment of a folding pliers multitool 80 in side view (rotary tool axis in side view), comprising pliers assembly 50, two handles 81 and 82, two reversible ratchet heads 86 and 88, and two multisockets 46 and 48. Pliers assembly 50 can be the same as discussed previously. Handle 81 comprises pivot stop 81*a*, and locking pivot hinge assembly 81*b*. Handle 82 comprises pivot stop 82*a*, and locking pivot hinge assembly 82*b*. Handles 81 and 82 are pivotally connected to multitool 80 with hinge pins 51*b* and 52*b*, respectively, and can pivot through a range of slightly less than one-hundred eighty degrees shown by range of motion arrows 89*a-b*, respectively. Ratchet heads 86 and 88 are pivotally connected to handles 81 and 82, respectively, with locking pivot hinge assemblies 81*b* and 82*b*, respectively. Ratchet head 86 and multisocket 46 can be substantially the same as ratchet head 49 and multisocket 46 seen in FIG. 2A. Rachet head 88 and multisocket 48 are larger than ratchet 86 and multisocket 46 to provide the ability to turn larger rotary fasteners. Ratchet head 86 has a standard ⅜ inch socket driver connector 86*a*, while ratchet head 88 has a standard ½ inch socket drive connector 88*a*. By providing two standard socket drivers (⅜ and ½ inch), most sockets that might be owned by the user to be used with multitool 80 simply by disconnecting the appropriate multisocket and attaching the user's socket. To provide additional advantages, handles 81 and 82 can each comprise a friction spring disk 81*c* and 82*c*, respectively, for holding the handles at a particular orientation for use. The disks would provide a friction force between handles 81 and 82, and plier arms 51*c* and 52*c*, respectively to hold them in position. Locking pivot hinge assemblies 81*b* and 82*b* can comprise any of a number of locking and/or friction hinges to provide stable positioning of ratchet heads 86 and 88 at a particular orientation with respect to handles 81 and 82, respectively. In this particular design, locking hinge assemblies 81*b* and 82*b*, comprise a spring loaded selector slide and a locking pin on the handles, and comprise a ridged outer surface around a pivot hinge pin on the ratchet head (reading from left to right in drawing). Many other prior art locking and friction hinge mechanisms for hand tools, wrenches and ratchets exist in the prior art and can be used with the disclosed folding pliers multitools. Hinge assemblies 81*b* and 82*b* allow ratchet heads 86 and 88, respectively to pivot through a range shown by range of motion arrows 87*a* and 87*b*, respectively. These range of motions can be approximately one-hundred eighty degrees for both ratchet heads 86 and 88.

In FIG. 4A, we see a side view of multitool 80 folded into its stowed position with handles 81 and 82 folded substantially adjacent pliers assembly 50, and multisockets 46 and 48 pivoted over the top surface of pliers assembly 50. This arrangement means that handles 81 and 82 are not perfectly parallel with plier arms 51*c* and 52*c*, respectively. This angle allows ratchet heads 86 and 88 to position multisockets 46 and 48, respectively, on the front face of pliers assembly 50 for stowage. Even with this offset of ratchets 86 and 88, the rotational axis of hinge pins 51*b* and 52*b* can be substantially parallel to the rotational axis of pivot hinges 81*b* and 82*b*. This arrangement can allow pliers assembly 50 to be angled with respect to handles 81 and 82 when extended for use of the pliers (see FIG. 4C). This angle, if placed near hinge pins 51*b* and 52*b* allows more ergonomic use near flat surfaces because the angle of the handles provide room for the user's fingers even when pliers assembly 50 is flat against that surface.

In FIG. 4B, we see a side view of multitool 80 folded out for use of ratchet head 88 and multisocket 48. Pivot stops 52*a* and 82*a* engage each other to prevent further rotation of handle 82. The group of handle 81, ratchet head 86, and pliers assembly 50 can then be used as the hand grip for the user to turn multisocket 48. Alternatively, if handle 81 and ratchet 86 were instead folded out, then multisocket 46 could be used to turn a rotary fastener, and handle 82, ratchet head 88, and multisocket 48 used as a grip handle for the wrench.

In FIG. 4C, both handles 81 and 82 are folded out to the left for use as the pliers' handles. Stops on the handles 81 and 82 and pliers assembly 50 allow the user to squeeze handles 81 and 82, and multisockets 46 and 48, press the pliers together for crimping, cutting and gripping. Additional griping power can be achieved with this design by further unfolding ratchets 86 and 88 and their multisockets 46 and 48, respectively through pivot ranges 87*a* and 87*b*, respectively. With multisockets 46 and 48 further extended, the user can grip the multisockets and use them as handle grips for operating pliers assembly 50. This provides extra long handles for folding pliers multitool 80 to provide superior gripping power for the pliers.

In FIGS. 5A-B, we see a fourth embodiment of a folding pliers multitool 90 in side view and bottom view, respectively, comprising a pliers assembly 50*a*, two pivotal handles 91 and 92, a double nested wrench head comprising nested wrench heads 31 and 33 pivotally mounted on handle 91, and a second double nested wrench head comprising nested wrench heads 32 and 34 pivotally mounted on handle 92. Pliers assembly 50*a* comprises nearly the same construction as pliers assembly 50 except that plier arms 51*c* and 52*c* on plier sections 51 and 52 have been replaced with similar plier arms 51*f* and 52*f*, respectively. Plier arms 51*f* and 52*f* position pivotal hinge pins 51*b* and 52*b* substantially perpendicular to the axis of plier hinge 57 instead of parallel as seen on pliers multitools 60, 64, 70, and 80. This allows handles 91 and 92 to fold on top of pliers assembly 50*a* using hinge pins 51*b* and 52*b*. Hinge pins 51*b* and 52*b* can be slightly offset toward the top surface of pliers assembly 50*a* and the left ends of handles 91 and 92 can be slightly curved downward to meet at hinge pins 51*b* and 52*b*, respectively. Handles 91 and 92 are pivotally attached to arms 51*f* and 52*f* with hinge pins 51*b* and 52*b*, respectively. Handle 91 comprises a pivot stop 91*a*, a handle indentation 91*b*, a hinge paw gap 91*c*, two hinge paw arms 91*d*, and a pivot pin 97*a*. Handle 92 comprises a pivot stop 92*a*, a handle indentation 92*b*, a hinge paw gap 92*c*, two hinge paw arms 92*d* and a pivot pin 97*b*. Wrench heads 31 through 34 can be substantially the same as previously discussed.

In FIGS. 5A-B, we can see that the folding direction of wrench handles 91 and 92 with respect to the pliers assembly is substantially perpendicular to the folding direction of the wrench handles in previous folding pliers multitools 64, 70, and 80. This ninety degree change in the direction of the folding axes of pivot pins 51*b* and 52*b* cause handles 91 and 92 to fold toward the top of multitool 90. Hinge pins 51*b* and 52*b* on plier arms 51*f* and 52*f*, respectively, allow handles 91 and 92 to pivot to a longitudinally adjacent position next to the top surface of pliers assembly 50*a* as shown in FIGS. 5A-B, instead of folding to a longitudinally adjacent position to the sides of pliers assembly 50 as seen on multitools 64, 70, and 80. The position and orientation of hinge pins 51*b* and 52*b* allow nested wrench heads 31 and 33, and nested wrench heads 32 and 34 to be folded substantially adjacent one another, respectively when stowed (see FIG. 5B). Note that in FIG. 5A, arms 91 and 92 are shown longitudinally adjacent plier assembly 50*a* and are substantially stowed in this position even though handle 92 is not fully pivoted down onto the top surface of pliers assembly 50*a*. Arm 92 was left slightly elevated to allow easier labeling of its components and also show variations on stowed positions. When in its stowed position (see FIGS. 5A-B) pliers assembly 50*a* fits into indentations 91*b* and 92*b* on handles 91 and 92, respectively. This arrangement allows the sides of indentations 91*b* and 92*b* to hold pliers assembly 50*a* in its closed position as seen in FIG. 5B for stowage and preventing spring clip 56 from opening the pliers' claws. Each indentations 91*b* and 92*b* can also keep pliers assembly 50*a* in its closed position by itself. For example, if handle 91 were folded out and away from pliers 50*a* for use of wrench head 31 or 33, then indentation 92*b* which remains folded in its stowed position would tend to hold pliers assembly 50*a* closed so that handle 92 and pliers assembly 50*a* can easily be used as a grip handle for handle 91 and its wrench heads 31 and 33.

In FIG. 5C, we see a side view of multitool 90 with both handles 91 and 92 folded out into its pliers configuration. In this position, handle 91 together with wrench head 91, and handle 92 together with wrench head 32 can be used as the hand grips for pliers assembly 50*a*. By properly designing handles 91 and 92 and their hinge pins 51*b* and 52*b*, pliers assembly 50*a* (as well as the other pliers disclosed in this patent) can be used at an angle to reach hard to get to objects (see alternate pliers position 50*z*). With pliers 50*a* in position 50*z*, handles 91 and 92 can still provide a gripping force to pliers assembly 50*a* for gripping objects. To facilitate this off-axis use of pliers assembly 50*a*, a locking mechanism can be added to hinge pins 51*b* and 52*b* (such as locking hinge assembly 81*b* and 82*b* seen in FIG. 4A). By providing such a locking mechanism, handles 91 and 92 can be pivoted to any angle for use of pliers 50*a*. Hinge pins 51*b* and 52*b* can also use a friction holding mechanism such as holding mechanism 47*b* seen in FIG. 2A, or friction spring disks 81*c* and 82*c* seen in FIG. 4A, to provide multitool 90 with sufficient friction around hinge pins 51*b* and 52*b* to prevent handles 91 and 92 from accidently pivoting when pliers assembly 50*a* is used at various angles. For off-axis use of handles 91 and 92, pliers hinge 57 can be made more rugged to survive the off-axis torques that can be applied to hinge 57 when used at non-parallel angles (off angles, see position 50*z*). Since the pivot axis of hinge pins 51*b* and 52*b* are substantially perpendicular to forces applied during use, stops 51*e*, 52*e*, 91*a*, and 92*a* are optional on pliers multitool 90, and are not needed for use of handles 91 and 92 with pliers assembly 50*a*. However, for some situations, where side forces are needed with the pliers, stops 51*e*, 52*e*, 91*a*, and 92*a* can be useful, thus are shown here in this example.

In FIG. 6A, we see a fifth embodiment of a folding pliers multitool 90*a* in side view in a substantially stowed position. Multitool 90*a* comprises a pliers assembly 50*b*, four handles 93, 94, 95, and 96 (folding arms), two double nested duplex box-end wrench heads 31 and 33 pivotally mounted on handle 93, two double nested duplex box-end wrench heads 32 and 34 pivotally mounted on handle 94, two double nested duplex open-end wrench heads 101 and 103 pivotally mounted on handle 95, and two double nested duplex open-end wrench heads 32 and 34 pivotally mounted on handle 96. Pliers assembly 50*b* comprises nearly the same construction as pliers 50*a* except that plier arms 51*f* and 52*f* are replaced with plier arms 51*g* and 52*g* which each have a top and bottom folding hinges (two hinges) instead of only one. Each of these folding hinges are oriented substantially perpendicular to the axis of pliers hinge 57. Plier arm 52*g* is behind plier arm 51*g* and is only seen in hidden lines in FIG. 6A, but structurally can be very similar to plier arms 51*g*. Plier arm 52*g* can have a structure that is substantially the mirror image of plier arm 51*g*. Plier arms 51*g* and 52*g* define a crimping and wire striping tool 53 similar to those seen in previous pliers designs. Plier arm 51*g* defines two hinges for hinge pins 51*b* and 51*h*. Hinge pins 51*b* and 51*h* are spaced further from the center line of pliers assembly 50*b* to allow handles 93 and 95 to pivot freely between the stowed position shown and an extended position where the handles are pivoted approximately one hundred eighty degrees in counter-clockwise and clockwise directions, respectively. Plier arm 52*g* also has two hinge pins (hidden behind arm 51*g*) similar to hinge pins 51*b* and 51*h* on plier arm 51*g*, to provide pivoting hinges for handles 94 and 96 similar to the pivoting hinges provided by hinge pins 51*b* and 51*h* for handles 93 and 95.

In FIG. 6A, handles 93, 94, 95, and 96 have a structure that is similar to handles 91 and 92 seen in FIGS. 5A-C, except for the shape of the handles near hinge pins 51*b* and 51*h*, which is less angled because of the new, more widely spaced positions of hinge pins 51*b* and 51*h*. For manufacturing purposes, handle 94 can have the same design as handle 95, and handle 93 can have the same design as handle 93 (but with different wrench heads). Notice that for multitool 90*a*, each of the handles 93 through 96 have slightly different structures to accommodate the different sized wrench heads and positions around pliers assembly 50*b*. Wrench heads 31 through 34 can be the same as previously discussed. Open-end duplex wrench heads 101, 102, 103, and 104 can have similar gripping surface sizes as wrench heads 31 through 34, respectively. However, in this design wrench heads 101 through 104 have open-end style wrench heads instead of box-ends style seen on wrench heads 31 through 34. In alternate designs, wrench heads 101 through 104 can have metric sized gripping surfaces, or other specially wrench types or styles as desired by the user. This configuration gives multitool 90*a* the ability to have sixteen different gripping surface sizes (i.e. eight duplex wrench heads). If quad wrenches are used (four gripping surfaces per wrench head, see FIG. 1D) a total of thirty-two different gripping surfaces can be provided. In alternate designs, wrench handles 95 and/or 96 can be replaced with alternative tool handles such as those disclosed in FIGS. 6B and 6C. In an alternate design, handle 95 might be replaced with screwdriver assembly 110 to provide four different screwdriver bits in a common prior art format. Handle 95 might also be replaced with allen wrench assembly 120 to provide a set of allen wrenches for multitool 90*a*. Similarly, handles 95 and 96 could be replaced with screwdriver assembly 110 and allen wrench assembly 120, respectively, to provide a needle nose pliers, a cutting pliers, a crimping and wire stripping tool, a full set of eight box-end wrench sizes, a set of four screwdrivers, and an allen wrench set, all in one compact multitool.

In FIG. 6A, each of the handles 93 through 96 can be pivoted one-hundred eighty degrees to the left individually for use of the wrench heads on the end of that handle. For use of pliers assembly 50*b*, all four handles can be pivoted to the one-hundred eighty degrees to the left so that handles 93 and 95 are substantially adjacent each other, and handles 94 and 96 are substantially adjacent each other. In this pliers configuration, handles 93 and 95 can provide one handle grip for pliers assembly 50*b*, and handles 94 and 96 can provide the other handle grip for the pliers assembly. A multitude of different orientations and configurations are possible with multitool 90*a* because of the many folding handles. Hinge pins 51*b* and 51*h* on plier arm 51*g* are used to provide hinges for handles 93 and 95, respectively. Plier arm 52*g* is hidden on the back side of FIG. 6A, and has hinge pins similar to hinge pins 51*b* and 51*g* that pivotally attaching handle 94 and 96, respectively. On the other end of handles 93, 94, 95, and 96 are mounted pivot pins 97*a*, 97*b*, 97*c*, and 97*d*, respectively. Box-end duplex wrench heads 31 and 33 are mounted to handle 93 with pivot pin 97*a*. Box-end duplex wrench heads 32 and 34 are mounted to handle 94 with pivot pin 97*b*. Open-end duplex wrench heads 101 and 103 are mounted on handle 95 with pivot pin 97*c*. Open-end duplex wrench heads 102 and 104 are mounted on handle 96 with pivot pin 97*d*. With this arrangement many different configurations can be used with multitool 90*a*. For example, wrench head 101 can be used in a short handle with extension by pivoting pliers assembly 50*b* and handles 93, 94, and 96 counter-clockwise ninety degrees around folding hinge pin 51*h* to a vertically upward position, and then pivoting wrench head 101 ninety degrees counter-clockwise around pivot pin 97*c*. In this position, wrench head 101 can grip a horizontally positioned fastener (i.e. fasteners mounted on the side of a vertical surface). Handle 95 can act as a tool extension arm for wrench head 101, while pliers assembly 50*b* and handles 93, 94, and 96 can be used as a short handle to turn the horizontal fastener. The many orientations of use of this and other disclosed multi-tools will be discussed further in the Operational Description section of this patent.

In FIG. 6B, we see a side-view of a screwdriver assembly 110 comprising a screwdriver pivot handle 112, a reversible screwdriver holder 114, and two double-ended screwdriver bits 115*a-b*. Screwdriver pivot handle 112 comprises a pivot stop 112*a*, a notch 112*b*, a receiving port 112*c*, and two engaging notches 112*d* on the end of receiving port 112*c*. In alternative designs pivot stop 112*a* can be replaced with a locking mechanism for this hinge to hold the screwdriver securely in place during use. Reversible screwdriver holder 114 comprises two screwdriver bit ports 114*a* and 114*b* having a hex socket size of 5/16 inch and 1/4 inch, respectively, and two locking tabs 114*c*. Each screwdriver bit 115*a* and 115*b* is reversible in bit ports 114*a* and 114*b*, respectively. Either end of screwdriver holder 114 can be inserted into receiving port 112*c* (see assembly path 119) with locking tabs 114*c* engaging notches 112*d* to allow torque to be transferred from pivot handle 112 to holder 114 and then to screwdriver bits 115*a* or 115*b*, and also to keep screwdriver holder 114 in receiving port 112*c* during use. Hinge pin 51*h* allows pivot handle 112 to replace handle 95 on multitool 90*a*, or with proper design, pivotal screwdriver assembly 110 can replace any of multitool handle disclosed in this patent.

In FIG. 6C, we see a side-view of an allen wrench assembly 120 comprising a handle body 121, a center support 121*a*, a pivot post 121*b*, and nine pivotal allen wrenches 122*a* through 122*j*. Hinge pin 51*h* is designed to allow allen wrench assembly 120 to replace handle 95 on multitool 90*a*, or any other handle on multitool 90*a*. Allen wrenches 122*a-d* pivot around pivot post 121*b*, while allen wrenches 122*e-j* can pivot around hinge pin 51*h*. In alternate designs, allen wrenches 122*e-j* can have a pivot tube at the location of hinge pin 51*h* to rotate on and can allow hinge pin 51*h* to fit through this pivot tube. No pivot stop surfaces are shown on this design since all the allen wrenches can be used while handle body 121 is in its stowed position (see position of handle 95 in FIG. 6A). In alternative designs, smaller or greater numbers of allen wrenches can be used, and other small rotary fastener tools with different shaped bit ends can be substituted or added to this design.

In FIG. 7A-B, we see a sixth embodiment of a folding pliers multitool 130 in top view and side view, respectively. Multitool 130 demonstrates how more than one wrench handle can be attached to a single folding hinge, as well as, how locking mechanisms might be used to hold the handles in a particular configuration. Multitool 130 comprises a pliers assembly 50*c*, eight pivotal wrench handles 131*a-b*, 132*a-b*, 133*a-b*, and 134*a-b*, and two locking hinge pins 135 and 136. Pliers assembly 50*c* is substantially the same as pliers assembly 50 except that pliers 50*c* has a pair of extra wide hinge paws 141 and 142 instead of the hinge posts seen on pliers head 50. Hinge paw 141 has two oversized pivot hole 141*a* and 141*b* one on each of its two paw arms. Pivot holes 141*a-b* are designed for mounting locking hinge pin 135 which pivotally attaches wrench handles 131*a*, 132*a*, 133*a*, and 134*a* to hinge paw 141. Hinge paw 142 has a similar structure with two oversized pivot hole 142*a* and 142*b* one on each of its two paw arms. Pivot holes 142*a-b* are designed for mounting locking hinge pin 136 which pivotally attaching wrench handles 131*b*, 132*b*, 133*b*, and 134*b* to hinge paw 142. Both locking hinge pins 135 and 136 has rings of locking teeth that can engage matching teeth on the pivotal handles to lock them in place with respect to hinge paws 141 and 142, respectively. Wrench gripping surfaces 31*a-b*, 32*a-b*, 33*a-b*, and 34*a-b* are mounted on the ends of wrench handles 131*a-b*, 132*a-b*, 133*a-b*, and 134*a-b*, respectively, to provide eight pivotal wrenches for multitool 130. Wrench gripping surfaces 31*a-b*, 32*a-b*, 33*a-b*, and 34*a-b* can be substantially the same size and shape as gripping surfaces 31*a-b*, 32*a-b*, 33*a-b*, and 34*a-b* seen in FIGS. 3A-C, 5A-C, and 6A-C, though with only one gripping surface per wrench head in this example. Each wrench handle, and its respective gripping surface, can be pivot through a range of approximately one-hundred eighty degrees from a stowed position adjacent pliers assembly 50*c* as shown, to a fully extended position substantially pointing in the opposite direction. In FIG. 7A multitool 130 is shown slightly expanded from its fully stowed position to allow easy labeling of the handles and gripping surfaces. For a completely stowed position, handles 133*a* and 134*a* can be folded behind handle 131*a*, and handles 132*b*, 133*b*, and 134*b* can be folded behind handle 131*b* to provide a stowed and pocket ready position.

In FIGS. 7A-B, locking hinge pin 135 and 136 are designed with two positions: 1) a locked position with the bottom end of the hinge pins in (see hinge pin end 135*a* pushed in FIG. 7B), and 2) an unlocked position with the top end of the hinge pins pushed in (hinge pin end 135*b* pushed down). This can give hinge pin 135 a sliding range shown by arrows 139. Hinge pins 135 and 136 can be structurally, and operationally, the same so I will limit most of the discussion to locking hinge pin 135 with the understanding that locking hinge pin 136 can have similar construction and operation. When hinge pin 135 is in the locked position, wrench handles 131*a*, 132*a*, 133*a*, and 134*a* are locked in place by engaging the teeth on hinge pin 135 with locking teeth 137*a-d* on wrench handles 131*a*, 132*a*, 133*a*, and 134*a*, respectively. Similarly, hinge pin 136 can lock wrench handles 131*b*, 132*b*, 133*b*, and 134*b* in place by engaging the teeth on hinge pin 136 with locking teeth 138*a-d* on wrench handles 131*b*, 132*b*, 133*b*, and 134*b*, respectively. When hinge pin 135 is unlocked by pressing hinge pin end 135*b* in towards hinge paw 141, locking teeth 137*a-d* no longer engage the teeth on hinge pin 135 and wrench handles 131*a*, 132*a*, 133*a*, and 134*a* can all be pivoted to the desired orientation and then be locked back in place by pushing in hinge pin end 135*a*. Locking hinge pin 136 works in a similar manner and locks and unlocks pivotal wrench handles 131*b*, 132*b*, 133*b*, and 134*b*.

In FIG. 7A, all eight wrench handles can be pivoted to the left and locked in place for use as the handles for the pliers assembly 50*c*. Multitool 130 is the only embodiment where the axis of pliers hinge 57, the axes of locking hinge pins 135 and 136, and the axes of wrench gripping surfaces 31*a* through 34*b* are all substantially parallel to each other. In each of the other wrench embodiments presented in this patent the axis of the wrenches' gripping surfaces are mounted substantially perpendicular to the axis of their handles hinge pin (i.e., hinge pins Sib, 52*b*, and 51*g*). Having the hinge pins perpendicular to the gripping surface axes allows these wrench embodiments to transfer torque to the gripping surfaces without the need for a locking hinge mechanism (though they can optionally be used). However, because the rotational axis of hinge pins 135 and 136 are substantially parallel to the rotational axis of the gripping surfaces (i.e., gripping surfaces 31*a* through 34*b*), a locking mechanism is needed to allow torque to be transferred through hinges 135 and 136 to the wrench heads and ultimately to a rotary fastener.

In FIG. 7B, we see a side view of multitool 130 in its compact stowed position. Many hidden lines are not shown in this drawing to keep the drawing readable, and wrench handles 131*b*, 132*b*, 133*b*, and 134*b* are hidden behind wrench handles 131*a*, 132*a*, 133*a*, and 134*a*. All eight wrench handles can be pivoted independently when their respective hinge pin 135 or 136 is unlocked, and then locked in place by moving their respective hinge pin to the locked position (see position of hinge pin 135 in FIG. 7B).

In FIGS. 8A-B, we see a seventh example of a folding compound pliers wrench tool 150 comprising a pliers head assembly 50*d*, large folding arm 151 with pivotally attached wrench heads 31*d* and 33, small folding arm 152 with pivotally attached duplex wrench heads 32 and 34, and a compound pliers arm assembly comprising upper lever arm 155, lower lever arm 156 and central hinge pin 157. This arrangement provides seven wrench sizes and a needle nose pliers with a cutter in a single multitool. Wrench heads 32, 33 and 34 are pivotal duplex wrench heads as previously discussed and provide two wrench sizes each. Wrench head 31*d* is a single size pivotal wrench head similar to wrench head 31 previously seen, but with only a single wrench gripping surface size 3 lb. Wrench head 31*d* is shown here to illustrate that the double nested wrench design can use a variety of wrench head designs for one or both of its pivotal nested wrench heads. Pliers head assembly 50*d* can be very similar to pliers assembly 50 and can have the same main hinge 57, cutting edges 54, and gripping surfaces 55. Crimping surfaces 53 have been removed from pliers head 50*d* to make room for the compound pliers assembly (155, 156, 157). Biasing spring 56 is not shown in this example to keep the drawing less cluttered, but can easily be included with pliers head 50*d*, or use another biasing spring that tends to open the plier head arms 153 and 154. Plier head arms 153 and 154 can be similar to plier assembly arms 51*c* and 52*c*, but are designed here to be slightly longer to allow additional room for compound lever arms 155 and 156 to operate. Many other types of pliers can be substituted for the needle nose arrangement seen on pliers head 50*d*.

In FIGS. 8A-B, folding arm 151 comprises a hinge paw 151*a*, an ergonomic gripping surface 151*b*, and a pair of hinge paw arms 151*d* with a gap 151*c* between them for wrench heads 31*d* and 33. Folding arm 152 comprises a hinge paw 152*a*, an ergonomic gripping surface 152*b*, and a pair of hinge paw arms 152*d* with a gap 152*c* between them for wrench heads 32 and 34. Ergonomic gripping surfaces 151*b* and 152*b* are designed to be gripped by a user, as both grip the handles when in pliers mode, as well as, a wrench handle when one of the wrench heads is being used. Ergonomic surfaces 151*b* and 152*b* extend along nearly the entire length of arms 151 and 152 and can include the outer surfaces of hinge paws 151*d* and 152*d*, respectively, and the outer surfaces of wrench heads 31*d* and 32, respectively. The reader should understand that this is only one example of a possible ergonomic surface shape that might be used. Wrench heads 32, 33 and 34 can be substantially identical to the same parts shown in other examples, and wrench head 31*d* is substantially a single gripping surface version of wrench head 31.

In FIGS. 8A-B, the compound pliers arm assembly comprising upper lever arm 155 and lower lever arm 156 are pivotally connected to each other with central hinge pin 157 which acts as a pair of lever arms for increasing leverage on lever pins 155*a* and 156*a*. Upper lever arm 155 is pivotally connected to folding arm 151 at hinge paw 151*a* with hinge pin 51*b* and also pivotally connected to pliers head arm 153 at hinge pin 155*a*. Lower lever arm 156 is pivotally connected to folding arm 152 at hinge paw 152*a* with hinge pin 52*b* and also pivotally connected to pliers head arm 154 at hinge pin 156*a*. Upper lever arm 155 comprises a hinge pin 155*a*, a pivot stop 155*b*, a locking arm 155*c* with a thumb handle 155*d*. Lower lever arm 156 comprises a pivot pin 156*a* and a pivot stop 156*b*. Hinge pins 155*a* and 156*a* are substantially perpendicular to folding hinge pins 51*b* and 52*b* in this example. In alternative designs, folding hinge pin 51*b* and 52*b* can be oriented parallel with compound hinge pins 155*a* and 156*a* and pliers head hinge 57 (see FIGS. 3A-C, 4A-C). In FIGS. 8A-B, pivot stops 155*b* and 156*b* provide a limit to the rotation of folding arms 151 and 152 respectively. When arms 151 and 152 are fully extended for use as pliers handles (i.e., stops 151*e* and 152*e* in contacting with stops 155*b* and 156*b* respectively), arms 151 and 155 can operate substantially as a upper lever arm, and arms 151 and 156 can operate substantially as a lower lever arm for use of compound pliers wrench tool 150. Thus, with arms 151 and 152 extended, arm pairs 151 & 155, and 152 & 156 act as lever arms that pivot around the central hinge pin 157 to move hinge pins 155*a* and 156*a* closer together or further apart as arms 151 and 152 are moved closer together or further apart respectively. Hinge pins 155*a* and 156*a* are pivotally attached to plier arms 153 and 154 respectively. Thus, the jaws of pliers 50*d* are opened and closed as folding handles 151 and 152 in their extended position are pressed and released respectively. This mechanical arrangement can provide approximately a two-to-one leverage advantage over a similar length pliers without a compound arm assembly. Alternate compound leverage systems can be used to create this leverage effect.

Operational Description

All the folding pliers multitools presented in this patent can operate generally in the same way. The user pivots the tool head they want to use into the open and uses that tool head, while one or more of the other tool heads and tool handles act as an extended handle grip. To use the pliers, all the handles are pivoted out so the user can grip them like as standard set of pliers. The specific operations of some multitool designs are a little more complicated, but still the operation is somewhat intuitive for some that uses hand tools regularly. However, there are many operational position and modes of operation that the reader may not immediately realize for these types of multitools. Thus, several operational examples will be discussed here.

Individual wrenches, with a single wrench size on the end of a handle, can be used with the folding multitools presented in this patent and operate like a standard wrench once folded out for use. However, the multitool designs can be made more ergonomic by adding other tools to the multitool. If multi-size wrench heads are used, the multitool can be made even more compact because less tool arms are needed for the same number of wrench sizes. Multi-sized wrench heads operate slightly differently depending on their style and type, but are well understood. The actual act of using the wrench head amounts to nothing more than engaging a rotary fastener with the wrench's gripping surface for that size fastener and turning the wrench handle (i.e. tool arm), and is well understood by most people. However, the different modes and positions for the handles and wrench heads are less obvious and will be discussed further.

Tool Operation

Though not discussed in detail here, the use of the wrench heads and other common hand tools are common knowledge. For use of wrenches, the wrench gripping surface is placed in contact with the rotary fastener's head and torque is applied to the wrench handle to turn the fastener. For other tools such as hammers, screwdrivers, pliers and others, most people intuitively know how to use these even if other pivotal handles are surrounding it in a stowed position. It is somewhat intuitive to pivot additional tools away from the main body of a tools to use it. However, because of the multitude of possible configurations of the tool handles, a few specific examples will be discussed to ensure complete understand.

Along with the standard operation of the attached tools, each multitool (pliers, tool handles and tool heads) can be placed in any or all of ten different functional positions or operational modes. These positions or modes comprise: 1) all have a folded and stowed position, 2) a short handled stowed position which also allows use of the wrench heads, 3) a screwdriver handle position (in both short handle and extended positions), 4) a driver handle position (handles pivoted at ninety degrees with respect to each other and wrench head pivoted parallel to its tool handle) this position can also get into deep indentations, 5) short handle position (can be substantially the same position as the driver handle position but with a different user grip angle), 6) a tool extension position (can be used in the driver handle position and the double handle position), 7) a crank handle position (gripping surface axis substantially parallel to the wrench handle being used as the crank handle), 8) a long handle position (one or more handles unfolded to provide an extended handle), 9) an extra long handle position (for double hinged handles like multisocket ratchets where the multisocket can extended again after the handle has been extended, 10) a double handle position (each embodiment disclosed in this patent can be pivoted to form a "T" shape with the pliers assembly and one pivotal handle forming the two handle grips, and the remaining pivotal handle pivoted perpendicular to the other to operate as a tool extension for one of the wrench heads), 11) a pliers handle position (handles folded out to be used as plier handles) and 12) positions for additional tools (i.e. reversible screwdriver positioning, allen wrench selection, etc.). This list does not include the fact that each of the pivoting handles can be rotated to a multitude of angles in-between these twelve functional positions and configurations. For example, one of the wrench heads might be angled at forty-five degrees with respect to its handle to allow it to reach an awkwardly placed bolt. While a forty-five degree angle on the wrench head is not an optimal configuration, it is in certain situations needed, and the ability to create these angles is beneficial. Normally this would require a specialty wrench for this situation, but because of the variety of angles possible, the folding multitools disclosed here can simulate a large number of curved and strangely shaped wrenches and tools. The specific operation of the multitools depend greatly on the arrangement of tool arms and the placement of the folding hinges to allow the multitool to function in above mentioned positions. In many cases, the "extended handle position" can also be an "extended operational position". The "short handle stowed position" is not available for some tools because some tools must be extended in order to use them properly (i.e. because other tools are in the way).

1) Stowed Positions (FIGS. 2C, 3A, 4A, 5A-B, 6A, and 7A-B)

One of the major advantages of the disclosed folding pliers multitools is that they can be folded to a stowed and compact size (pocket ready form). The stowed position can minimize the overall size (length) of the tool set by pivoting the handles substantially adjacent the pliers assembly. The multitool examples shown in this patent are often shown in a stowed position, but someone skilled in engineering can optimize these configurations for storage size by making their stowed positions even more compact than shown. All of the multitool examples (FIGS. 2C through 7B) comprise a full set of wrenches or sockets (each example shows four or more fixed wrench sizes or two adjustable multisockets). This was done because of the great advantage of having a large set of wrench sizes permanently attached to a single tool so they cannot be individually lost. Wrench sets are commonly sold with as little as four wrench and/or socket sizes, and these multitools can use these smaller numbers of wrench sizes if desired for specific purposes (i.e. for a bicycle tool). Further, the disclosed multitools can include many other tools besides rotary fastener tools (i.e. various knives, screwdrivers, files, bottle openers, can openers, scissors, pry tools, flashlights, nail files, fishing tools, and various other hand tool) can be added to the disclose multitools similar to how they are placed on existing folding pliers multitools. Substitution of additional tools can be done by substituting one of the disclosed wrench handles for a prior art folding pliers handle.

In FIG. 2C, we see multitool 64 in its stowed position, with each tool handle 65 and 66 folded to a substantially parallel position and longitudinally adjacent to pliers assembly 50. In other configurations the tool handles might be curved for ergonomic reasons. A more compact stowed position can still be achieved by folding the handles closer together to occupy the minimum volume. The reader might notice that it is difficult to defining exactly what a compact stowed position is. Even though most people would be able to identify a stowed position if they saw it, a stowed position is difficult to define in concrete terms needed for patent claims. For example, an alternate way to define the stowed position is to define the stowed length as being less than 80%, 70%, 60%, and/or 55% of the multitools fully extended length. Another alternate definition of a stowed position can be where all the tool handles are pivoted to provide the shortest length for the multitool. Another definition of stowed might be a position where the multitool is less than seven inches long (maximum dimension). Another definition might be that the stowed position is where all the tools are folded so that they can touch at least one other tool or handle (i.e. wrench handles and/or wrench heads touching the pliers assembly). Thus, because of this ability to be defined stowed in so may ways, sufficient examples have been provided in this patent so that nearly anyone should be able to understand what is meant by "substantially stowed" (significantly smaller configuration than its extended operational position) and/or "pocket ready" (fits in a typical pants pocket).

In FIG. 3A, we see multitool 70 in its stowed position with clips 74*a-b* gripping pliers assembly 50 to hold handles 71 and 72 in place substantially parallel to each other. Spring clips 74*a-b* help hold multitool 70 in this stowed position by overcoming the tendency for pliers assembly 50 to open due to biasing by spring clip 56. In FIG. 4A, we see multitool 80 folded in its stowed position with handles 81 and 82 folded to the edges of pliers assembly 50, but angled out of the page slightly so that multisockets 46 and 48 can rest on the flat surface of pliers assembly 50. In FIGS. 5A-B, we see multitool 90 folded substantially in its stowed position with indentations 91*b* and 92*b* receiving pliers assembly 50*a* in its closed position. Indentations 91*b* and 92*b* can each hold pliers assembly 50*a* in its closed position (see FIG. 5B) against the force from spring clip 56. In FIG. 6A, we see multitool 90*a* folded substantially in its stowed position, which is similar to the stowed position of multitool 90, but with folded handles on both sides of pliers assembly 50*b*. In FIG. 7A, we see multitool 130 in a stowed position with its wrench handles slightly spread. All the wrench arms can be folded down against pliers assembly 50*c* to make the tool even more compact for stowage. FIG. 7B shows a side view of the same multitool 130 in its stowed position.

2) Stowed Operation (Multitools 70 and 90)

Many of the multitool designs disclosed in this patent can use all their wrenches when in their stowed position, some of their wrenches while stowed, and others like multitool 80, seen in FIG. 4A, cannot use any of its gripping surfaces while stowed because of the nature of its stowed position. Further, some multitools, such as multitool 90*a*, have difficulty using some of its gripping surfaces while stowed because of the multitude of wrench heads located in the same area. Multitool 64 seen in FIG. 2C, and multitool 130 seen in FIGS. 7A-B, can only use their outward facing gripping surfaces 67*a-b* & 68*a-b*, and 31*a-b* & 33*a-b*, respectively, while completely folded in their stowed position. The other embodiments, multitools 70, and 90, can use all their wrench gripping surfaces while folded in their stowed positions. Both multitool 70 seen in FIG. 3A, and multitool 90 seen in FIG. 5A-B, can effectively use any of their gripping surfaces in the shown stowed positions simply by pivoting undesired wrench heads out of the way and pivoting the wrench head to be used to the desired angle. For example, if gripping surface 31*b* is to be used, wrench head 32 can be pivoted up and out of the way, while wrench head 31 can be angled upward slightly. This allows gripping surface 31*b* easy access to a rotary fastener without pliers assembly 50 or 50*a* interfering. If gripping surface 31*a* is to be used, wrench head 32 can again be pivoted away from wrench head 31 and wrench head 31 pivoted clockwise slightly to position gripping surface 31*a* at an angle so that it can reach a rotary fastener, or wrench head 31 can be pivoted fully clockwise until it is against handle 71 or 91 and/or wrench head 33, which fully exposes gripping surface 31*a* for easy use. This last position does not placed multitool 70 in its most compact vertically stowed configuration (see narrowest stowed configuration in FIG. 3A, with wrench head 36 folded down into hinge paw 72*c*), but with wrench heads 31 and 32 folded back against handles 71 and 72, respectively in FIG. 3A, or handles 91 and 92, respectively in FIG. 5A, this stowed position is actually the shortest stowed configuration for multitool 70 and 90, and can easily fit in a user's pocket.

3) Screwdriver Handle Operation (Multitools 70, 80, 90, and 90*a*)

Most of the multitools presented here can be grasped like a screwdriver while in their stowed position and used like a screwdriver to turn specific gripping surfaces. However, multitools 70, 90 and 90*a* are somewhat cluttered around the wrench head being used because of all the other wrench heads. Thus, use in the "screwdriver mode" for these multitools is limited to rotary fasteners that are relatively free of obstructions around them. However, multitools 70 and 90 can pivot unused handles out of the way and use the pliers assembly and the one wrench handle being used as the screwdriver handgrip. Multitool 80 is constructed slightly differently and can be used in screwdriver operation mode in nearly all situations because each multisocket can pivot one-hundred eighty degrees from its stowed position to provide unobstructed access to a rotary fastener. For example, in FIG. 4A, if ratchet head 88 and multisocket 48 are pivoted one-hundred eighty degrees to the right, multisocket 48 is free to turn a rotary fastener, while handles 81 and 82, multisocket 46 and pliers assembly 50 can be used as a screwdriver style handgrip. Note handle 81 and multisocket 46 can be pivoted out of the way to provide a smaller screwdriver handgrip comprising handle 82 and pliers assembly 50.

4) Driver Handle (Multitools 70, 80, 90, and 90*a*)

The driver handle position and the short handle position on most of the disclosed multisockets are substantially the same physical position, but the user determines whether it is to be used in driver handle operation or short handle operation by how they grasp the multitool. For example, in FIG. 3A, multitool 70 can be placed in a driver handle position (short handle) by pivoting handle 71 ninety degrees clockwise while keeping wrench head 31 in its shown orientation (gripping surface axis is vertical). In this position, the user can grasp handle 72 and pliers assembly 50 to turn wrench head 31. If the user grasps handle 72 and pliers assembly 50 with their forearm substantially parallel to handle 71, then they are using the multitool substantially like a driver wrench. If however, the user grips handle 72 and pliers assembly 50 with their forearm substantially perpendicular to handle 71 then they are using multitool like a short handled wrench (with tool extension). Similar positions can be achieved on multitools 80, 90, and 90*a*.

5) Short Handle Operation (Multitools 70, 80, 90, and 90*a*)

The short handle operating position is substantially the same as the driver handle position, only the way the user grips the wrench handle determines which mode of operation they are using. For example, in FIG. 4A, if wrench arm 81 and multisocket 46 are both pivoted to point vertically downward (handle 81 and multisocket 46 pivoted ninety degrees clockwise, then multisocket 46 pivoted another one-hundred eighty degrees clockwise), then the user can grip handle 82, ratchet 88, multisocket 48, and pliers assembly 50 and use them as a short handle. The user's forearm can be substantially in the same plane as the rotation of the handle grip (handle 82, ratchet 88, multisocket 48, and pliers assembly 50 in this example) to use this configuration like a short handle. For short handle operation the user's arm is positioned to the side of the axis of the rotary fastener being turned, while in a driver handle operation the users arm can be substantially above the with the rotary fastener (approximately inline with the rotary fastener's rotational axis). Multitools 70, 90, and 90*a* can be oriented in substantially the same position and used the same way.

6) Tool Extension Operation (Multitools 70, 80, 90, and 90*a*)

Multitools 70, 80, 90 and 90*a* can also provide a tool extension function for their wrench heads. The use of one of the handles as a tool extension allows the tool heads to be extended into a narrow passage or deep well that the tool head could not reach by itself. For a tool handle to be used as an extension, the rotary axis of the gripping surface to be used should be pivoted substantially parallel with the longitudinal axis of the tool handle being used as the extension. This tool extension function naturally comes about when multitools 70, 80, 90 and 90*a* are placed in their driver handle, short handle, or double handle positions. Multitool 80 along with being able to provide an extension in its short handle configuration can also fold out its multisocket to provide a long handle position with a tool extension. For example, in FIG. 4A, handle 81 and multisocket 46 can be folded clockwise ninety degrees to a vertically position, and then multisocket 46 rotated clockwise another one-hundred eighty degrees clockwise to point in a vertically downward direction. In this position handle 82, multisocket 48 and pliers assembly 50 provide a short handle or driver handle grip and handle 81 provides the tool extension. Then if multisocket 48 and ratchet 88 are pivoted one-hundred eighty degrees counter-clockwise from this position, multisocket 48 now extends to the right and can be used as an extended handgrip or long handle (combined handle length of handle 82 and multisocket 48). This provides multitool 80 with the ability to use a tool extension with both short and long handle grips.

7) Crank Handle Operation (Multitools 64, 70, 80, 90, and 90*a*)

Each of the disclosed embodiments of the folding pliers multitool can be used in a crank handle position (gripping surface axis substantially parallel to the wrench handle being used as the crank handle) though some gripping surfaces on the duplexed wrench heads are easier to use than other. For multitools 64, 70, 90 and 90*a*, a crank handle position can be achieved by simply pivoting one wrench handle ninety degrees away from the other handles and pliers assembly. For example, in FIG. 3A, gripping surface 31*b* can be used with a crank handle by pivoting handle 72 vertically upward (ninety degrees counter-clockwise). Then handle 72 can be grasped to rotated handle 71 around the vertical axis of gripping surface 31*b*. From the same position, gripping surface 31*a* can be used by pivoting wrench head 31 clockwise against handle 71 and again use handle 72 as the crank grip. This position shortens the crank arm for gripping surface 31*a* when compared to gripping surface 31*b*. Alternatively, gripping surface 31*a* can be used with an longer crank arm by pivoting handle 71 one-hundred eighty degrees counter-clockwise to the other side of pliers assembly 50 and use handle 72 (still vertical) as the crank grip. This second crank handle position provides a similar crank arm length, but is not as ergonomic as for gripping surfaced 31*b* because pliers assembly 50 sticks out passed handle 72 during the cranking operation. The other gripping surfaces on multitool 70 can be used in crank operation in a similar manner. Similarly, multitools 64, 90, and 90*a* can be used in crank handle position. Multitool 80 can also be used in a crank handle position, but has a slightly different fold out position. For example, in FIG. 4A, to use multisocket 46 with a crank handle, handle 81 and multisocket 46 can be pivoted ninety degrees clockwise, and then multisocket 46 can be further pivoted one-hundred eighty degrees clockwise around hinge 81*b* to point vertically downward, while handle 82 is pivoted one-hundred eighty degrees counter-clockwise and multisocket 48 is pivoted an additional ninety degrees to a vertical upward position. Then multisocket 48 can be used has the crank handgrip and handle 82 as the crank arm. Torque would be transferred through pliers assembly 50, and down handle 81 to ratchet 86 and multisocket 48. Handle 81 would also operate as a tool extension in this position.

8) Long Handle Operation (Multitools 64, 70, 80, 90, 90*a*, 130 and 150)

Each of the disclosed folding pliers multitools can be operated in a long handle position (one or more handles unfolded to provide an extended handle). Each multitool can extended one of its wrench handles approximately one-hundred eighty degrees to use its wrench heads and gripping surface(s), while the remaining handles and pliers assembly can be used as a long handle handgrip. This long handle configuration will in many cases be considered the "normal" operating position for that particular tool. For the folding multitools in this patent, each tool on a folding arm can be placed in its long handle operational position by simply folding out the tool handle to be used. For example, in FIG. 3A, any of the wrench head gripping surfaces on handle 71 can be used by simply pivoting handle 71 clockwise approximately one-hundred eighty degrees to the left side of pliers assembly 50. In this position, each wrench head 31, 33 and 35 can pivot to multiple positions that allows each gripping surface to be used with handle 71 operating as a lever arm. Handle 72 and pliers assembly 50 then provide an extended handgrip for the multitool. Multitools 64, 80, 90, and 90*a* would operate in a similar manner. Multitool 130 in FIG. 7A-B, would use a similar configuration, with the wrench handle to be used pivoted approximately one-hundred eighty degrees from the other handles and pliers assembly. However, with multitool 130, the locking hinge pin 135 or 136 for the wrench handle being used, must be in its locked position so that torque can be transferred from other handles and pliers to the wrench handle being used. Ideally, both hinge pins 135 and 136 are in their locked position while multitool 130 is being used.

9) Extra Long Handle Operation (Multitool 80)

Multitool 80 seen in FIG. 4A-C, can also be used in an extra long handle position (double hinged foldout of handle and multisocket). For example, in FIG. 4B, ratchet 86 and multisocket 46 can be pivoted clockwise one-hundred eighty degrees (to the left) to further extend the handle for turning multisocket 48, as shown. Thus, ratchet 86 and multisocket 46 can be used as a handgrip with handles 81 and 82 extended substantially in parallel to provide an extra long handle for ratchet 88 and multisocket 48. Note that multitools 70, 90, and 90*a* provide a somewhat extra long handle position in their normal long handle position because large wrench heads 31 and 32 extend beyond their respective handles to provide a small added length to the handle. This type of unfolding also allows multitool 80 to fold to less than fifty percent (50%) of this fully extended length. In this particular example, multitool 80 can folded to approximately forty percent (40%) of its fully extended length, and could be redesigned to fold to an even smaller percentage.

10) Double Handle Operation (Multitools 70, 80, 90, 90*a* and 150)

All but multitools 64 and 130 can be used in a double handle position. This position is formed by pivoting the components of the multitools into a "T" shape arrangement with the pliers assembly and one pivotal handle forming the two handle grips, and the remaining pivotal handle pivoted perpendicular to them to operate as a tool extension for one of the wrench heads. For example, in FIG. 3A, multitool 70 can be used as a double handle tool by pivoting handle 71 ninety degrees clockwise (pointing downward), and pivoting handle 72 one-hundred eighty degrees counter-clockwise. This orients handle 72 and pliers assembly 50 horizontally to provide the two handles for gripping, while handle 71 operates as a perpendicular extension for wrench heads 31, 33 and 35. Then by pivoting wrench head 31, 33, or 35 so that the gripping surface to be used is pointing downward, the user can turn a rotary fastener. By reversing the pivoting handles, wrench heads 32, 34 and 36 can be used in a double handle position. Multitools 80, 90, and 90*a* can similarly be pivoted to a double handle position for each of its wrench or socket tools.

11) Pliers Handle Position (Multitools 64, 70, 80, 90, 90*a*, 130 and 150)

All of the disclosed multitools can be used as a pliers, and in these examples. Each of the tool functions of needle nose pliers, cutting pliers and crimping and wire stripping pliers can be used from this position. Each of the multitool have at least two folding handles that can be pivoted to the opposite end of their pliers assembly to be used as the handgrips for the pliers. For example, in FIG. 3C we see multitool 70 with both its handles 71 and 72 pivoted to the left and prevented from pivoting further by stops 51*a* and 71*a*, and stops 52*a* and 72*a*, respectively. Spring clip 56 tends to open plier sections 51 and 52 to provide ergonomic operation for the user. Multitools 80 and 90 are also shown in their pliers configuration in FIGS. 4C and 5C, respectively. The handles on multitools 64, 90*a*, and 130 can fold out in a similar manner to provide these tools with a pliers configuration. Multitools 90*a* and 130 actually provides more than one handle per handle grip. For multitool 90*a*, handles 93 and 95 would fold out to act as one handle grip, while handles 94 and 96 would fold out to act as the other handle grip for pliers assembly 50*b*. For multitool 130, handles 131*a*, 132*a*, 133*a*, and 134*a* would fold out to act as one handle grip, while handles 131*b*, 132*b*, 133*b*, and 134*b* would fold out to act as the other handle grip for pliers assembly 50*c*. These operational pliers position do not have change if one or more of the handles are swapped out for screwdriver assembly 110, or allen wrench assembly 120, or any other alternate tool handle.

12) Additional Tool Position (Multitool 90*a* and 130)

While each of the disclosed multitools can have additional tools besides wrench, sockets and pliers, only multitool 90*a* is shown designed for directly substituting one of its wrench handles for tool assemblies 110 and 120. Tool assemblies 110 and 120 are shown in FIGS. 6B-C as examples of possible alternative tool handles. Multitool 90*a* can be designed so that handles 95 and 96 can be replace with these alternative handles, while still providing a full set of eight duplex wrench gripping surfaces. Screwdriver assembly 110 seen in FIG. 6B is specifically designed to replace wrench handle 95 on multitool 90*a* and provide a highly functional screwdriver assembly for use with the other wrench tools. Similarly, if wrench handle 96 on multitool 90*a* can also be replaced with allen wrench assembly 120, then even more types of tools can be incorporated into this multitool design. Alternatively, other hand tools can be substituted for wrench handles 93, 94, 95 and/or 96 to provide the user with the desired combination of hand tools for their specific industry.

Multitool 130, seen in FIGS. 7A-B, is the only design that folds along an axis that is substantially parallel to the gripping surface axes. This arrangement requires a locking mechanism for the handles during use, and allows "L" shaped wrenches to be formed to get behind obstructions to reach a rotary fastener that none of the other multitools can reach. For example, any of the pivotal handles on multitool 130 can be pivoted out to approximately ninety degrees and locked in place so that the other handles and pliers assembly can be used as a right angle handgrip (note other angles between zero and one-hundred eighty can be used). In this configuration, the gripping surface that has been extended can reach behind a vertical obstruction to reach a vertical axis rotary fastener. The other multitools have difficulty preforming this function because they are primary designed to reach a vertical rotary fastener either from above or from around a horizontal obstruction (wrench handle pivoted to approximately ninety degree angle). Thus, multitool 130 can operate in places the other multitools can not, but is also limited by its configuration from pivoting to some position that the other multitools 64, 70, 80, 90, and 90*a* can.

Locking Mechanism (FIGS. 2A, 3A-C, 4A-C, and 7A-b)

Various types and styles of locking mechanisms are disclosed in this patent, but should be considered by the reader as a small sample of the types and styles of locking and latching mechanisms that can be used with hand tools. In FIG. 2A, friction holding mechanism 47*b* is seen uses a spring to force a ball against a ridged surface to help hold an a hinge at a particular orientation. The user simple applies sufficient force to the hinge to pivot it. In FIGS. 3A-C, friction clips 74*a* and 74*b* are seen on multitool 70 mounted on handles 71 and 72, respectively, and provide a gripping force on pliers assembly 50 to hold handles 71 and 72 in their stowed positions (see FIG. 3A). The gripping force provided by clips 74*a-b* helps hold pliers assembly 50 in its closed position (shown in FIGS. 3A-C) against the force provided by spring clip 56 which is trying to open pliers 50. Notice that only one tool handle and friction clip is needs to be in its stowed position (see handle 72 in FIG. 3B) to hold pliers assembly 50 in its closed position. In FIG. 4A, friction mechanism 81*c* and 82*c* seen comprises two spring disks that when compressed between arm 51*c* and handle 81, and arm 52*c* and handle 82, respectively, provide a consistent friction force to hold the handles at a particular orientation with respect to the plier arms. In FIGS. 4A-C, locking mechanisms 81*b* and 82*b* operate by using a spring loaded control slide pin to force a locking pin or ball against a ridged surface to temporarily lock that hinge in a particular orientation. To change the orientation of the hinge, the user presses on the control slide pin to release pressure on the locking pin or ball so that the ridged surface can be rotated to a new orientation. Releasing the control slide pin locks the locking pin or ball back against the ridged surface. Many of the multitools disclosed in this patent can benefit from using a locking mechanism like this to make it easier to use the multitools in various positions (long handle, short handle, double handle, etc.). Because of the nature of a screwdriver, a locking mechanism may be highly desirable on pivotal handle 112 (see FIG. 6B) to help stabilize the screwdriver during use (screwdriver extended away from other handles (i.e. handles 93, 94, and 96, and pliers assembly 50*b*). Similarly, many other multitools can also benefit from a locking mechanism on some or all of the pivotal hinges.

Locking Hinge Pins (FIGS. 7A-B)

In FIGS. 7A-B, we see an example of a locking mechanism for the folding arms (wrench arms). Locking hinge pins 135 and 136 are used to lock and unlock the handles attached to these hinge pins. Hinge pins 135 and 136 can be similar to prior art hinge pins that use rings of gripping teeth to lock the hinge pin in place with respect to its hinge paw and to a wrench handle, and can shift to a second unlocked position where the ring of gripping teeth do not engage the wrench handle and/or hinge paw. Craftsman® sells a wrenches with this type of dual position locking hinge pin but are only designed for a single handle. The Applicant's disclosed locking hinge pins 135 and 136 teach a novel means for locking several pivotal handles at one time, not just one handle. Because both locking hinge pins 135 and 136 can be structurally and functionally the same I will only discuss the operation of locking hinge pin 135, with the understanding that locking hinge pin 136 can operate in a similar manner.

Looking at FIGS. 7A-B, we can see that hinge pin 135 passes through hinge paw 141, and wrench handles 131*a*, 132*a*, 133*a*, and 134*a* to provide a pivotal hinge for these wrench handles. Hinge pin 135 has alternating rings of gripping teeth and open sections along its length. Hinge paw 141 has matching teeth on the inside pivot holes 141*a* and 141*b*, for gripping the rings of teeth near ends of hinge pin 135 to prevent hinge pin 135 from rotating during use. Each pivotal handle 131*a*, 132*a*, 133*a*, and 134*a* has a matching set of teeth 137*a*, 137*b*, 137*c*, and 137*d*, respectively, that can engage one of the rings of teeth on hinge pin 135 to lock them in position. FIG. 7B shows hinge pin 135 in its locked position with hinge pin end 135*a* pushed in. In this locked position, the rings of teeth on hinge pin 135 each engage the teeth 137*a*, 137*b*, 137*c*, and 137*d* and lock them in position with respect to hinge paw 141. A ring of teeth near hinge pin end 135*b* engage the locking teeth on the inside surface of pivot hole 141*b* on hinge paw 141 to prevent hinge pin 135 from rotating. An additional ring of teeth can be used near hinge pin end 135*a* to engage gripping teeth on inside surface of pivot hole 141*a* on hinge paw 141. When hinge pin end 135*b* is pushed in, hinge pin 135 slides to an unlocked position where the empty space between the rings of teeth on hinge pin 135 align with locking teeth 137*a-d* so that handles 131*a*, 132*a*, 133*a*, and 134*a* can rotate freely around hinge pin 135. In this unlocked position, teeth on hinge pin 135 engage locking teeth on the interior of pivot hole 141*a* on hinge paw 141 to prevent hinge pin 135 from rotating. A holding means can also be included with hinge pin 135 to help hold the hinge pin in its locked or unlocked position once placed in that position. In this way, the user can alternately lock and unlock all the pivotal handles on multitool 130 with hinge pins 135 and 136. These two positions for hinge pin 135 are shown by range of motion arrows 139.

While more examples could be provided on various structures and operations of the disclosed folding pliers multitool, the above descriptions should be sufficient for most mechanically inclined people to understand how to build and use the disclosed multitools.

Compound Hinge Folding Pliers (FIGS. 8*a*-B)

In FIGS. 8A-B, we see folding pliers wrench tool 150. When using any of the wrench heads 31*d*, 32, 33 and 34, the appropriate folding arm is pivoted away from pliers head assembly 50*d* so that the desired wrench head is extended and pliers assembly 50*d* and the other folding arm can be used as a wrench handle. For example, if wrench head 33 is desired for use, folding arm 151 can be pivoted out and away from pliers head 50*d* and wrench heads 31*d* and 33 can be pivoted around hinge pin 97*a* to extend head 33 away form hinge paw 151*d* and over a rotary fastener to be turned. Then the user grips pliers head 50*d* and folded arm 152 (including wrench heads 32 and 34) as the handle and applies torque to the rotary fastener (i.e., bolt, screw, nut, etc., not shown). Compound lever arms 155 and 156 can be made substantially stronger than for a typical compound plier arms to support the added torques when used to turn wrench heads 31*d*, 32, 33 and 34. Notice that torque is applied perpendicular to folding hinges 51*b* and 52*b* so that torque can be transferred to arms 151 and 152 respectively, without a locking mechanism on hinges 51*b* and 52*b* respectively. However, a friction system (such as friction washers 81*c* and 82*c* seen in FIG. 4A) is desirable at hinges 51*b* and 52*b* to provide ergonomic use. When pliers head 50*d* is being used as a handle for one of the wrench heads, locking arm 155*c* can be pivoted against a portion of lever arm 156 as shown in FIG. 8B to force gripping surfaces 54 and 55 together and significantly reduce the pinch hazard for the user by pliers head 50*d*. To release pliers head 50*d*, locking arm 155*c* would be rotated counter-clockwise from the position seen in FIG. 8B so that the plier jaws can open for use. In alternative designs, arms 151 and 152 can provide an indentation for pliers head 50*d* so that pliers head fits snugly in the indentation in each arm (see FIGS. 5A-B) to force plier surfaces 54 and 55 together when being used as a handle for one of the wrench heads. Wrench heads 31*d* and 32 can also provide a similar locking function if positioned correctly with respect to pliers head 50*d* so that head 31*d* or 32 can be angled to force the jaws of pliers head 50*d* together (see FIG. 8B).

In FIGS. 8A-B, folding pliers wrench 150 is shown in its substantially stowed position with folding arms 151 and 152 substantially parallel and adjacent pliers head 50*d*. When using pliers head 50*d*, arms 151 and 152 can be pivoted out away from pliers head 50*d* to a desired angle and used as the handles for pliers head 50*d*. The compound arm assembly (155, 156, and 157) works much more effectively when arms 151 and 152 are fully extended (one-hundred eighty degrees from their stowed position) though pliers head 50*d* can be angled to get into tight areas. With folding arms 151 and 152 aligned with compound lever arms 155 and 156 respectively (stops 151*e* and 152*e* seated against stops 155*b* and 156*b*, respectively), each pair of arms can act as a single arm hinged at compound hinge 155*a* and 156*a*, respectively. Thus, with arm pair 151 and 155 and arm pair 152 and 156 are pivotally hinged at central hinge pin 157 they act together to provide leverage on hinge pins 155*a* and 156*a* to press plier head arms 153 and 154 together respectively. Because plier head arms 153 and 154 are approximately twice as long as the distance between compound hinges 155*a* and 156*a*, and central hinge 157, the compound arm assembly provides approximately twice the clamping force on pliers surfaces 54 and 55 compared with a simple pliers configuration.

RAMIFICATIONS AND SCOPE

The disclosed folding pliers multitools provide a full set of rotary fastener tools in a convenient folding multitool format. The multitool is able to fold to a very compact state because the tool handles can be extended for used as handles for the other tools. This double duty use of the multitool components reduces the overall weight of the collection of tools, which can be much less than half the weight of the same collection of tool found separately. Further the disclosed multitools can have multiple hinges and multiple handles per plier arm, which allows eight or more tool handles to be mounted ergonomically on a single multitool.

Although the above description of the invention contains many specifications, these should not be viewed as limiting the scope of the invention. Instead, the above description should be considered illustrations of some of the presently preferred embodiments of this invention. For example, it should be obvious from the above discussion that any kind of wrench head can be used, and/or mixed and matched with other tools as needed. Standard style wrenches with single size wrench heads can be used with this invention to provide a full set wrenches, but duplex and quad wrench heads allow larger numbers of gripping surfaces without adding significant weight. Even ratcheting wrench heads can be used in place of the fixed wrench heads disclosed by simply adding a ratcheting mechanism to the wrench heads. Other embodiments can comprise additional hinges placed between the ends of the handles to provide additional folding of the wrench. The reader should also see that more than one pivotal handle can be placed on a single hinge pin similar to how two wrench heads 20*a-b* are mounted on a single hinge pin 26 in FIG. 1B. This allows greater numbers of handles to be added as needed for particular tools. Also many different shapes are possible for the wrench head arms and wrench handles to provide various ergonomic advantages for gripping and storage (See FIG. 8B). For example, a handle curved to fit a users palm and fingers in a number of ways and can be used to provide better gripping while using the multitool in a pliers configuration. More organic shapes (gently curved handles) can also be used for aesthetic reasons alone. The reader should further understand that many other hand tools can be used with the disclosed folding multitool designs. For example, one tool arm could house a Swiss army knife like tool, with multiple fold out knives, screwdrivers, spoon, fork, etc. Almost any hand tool can be incorporated into the disclosed folding multitool. Finally, while many ergonomic embodiments have been shown here, these are only examples of the personal preference of the Inventor, and a vast array of designs can be substituted, depending on the specific needs of a particular group of users. For example, for a carpenter, might want to include a hammer that can easily be used in the multitool's stowed position, and also in the extended or long handle position when needed. In this case, the carpenter may want multitool 90*a*, seen in FIG. 6A, to include a hammer handle and hammer head replacing handle 96 and screwdriver assembly 110 replacing handle 95. Another example might be an electrician where a special pliers head is used on the tool and other special tools (specialty wrenches, wire stripers, crimpers, etc.) can be placed on the folding arms. For other users, significantly different configurations might be considered more useful or ergonomic.

Finally, all the wrench heads shown in this patent are full sized wrenches (wrench head height greater than one-third their wrench size) Thinner wrench heads can easily be used with the disclosed folding pliers multitool, but as the wrench heads' height is decreased below approximately one-third of the wrench's gripping surface size, the wrenches become more and more difficult to use in real world environments. So while thinner wrench heads can easily be used with the disclosed invention, most professionals would prefer using full sized wrench heads.

Thus, the scope of this invention should not be limited to the above examples, but should be determined from the following claims.

I claim:

1. A hand tool, comprising:

a) a pliers head assembly comprising a first and second plier sections pivotally attached at a pliers hinge defining a pivotal axis;

b) a first and second folding arm each comprising a first and second end;

c) wherein the first end of the first folding arm comprises a first folding axis for pivotally attaching the first folding arm to the first plier section, and wherein the first end of the second folding arm comprises a second folding axes for pivotally attaching the second folding arm to the second plier section;

d) wherein the first and second folding arms are each pivotal to an extended position, and a stowed position;

e) wherein the second ends of the first and/or second folding arm(s) define a set of wrenches, wherein the set of wrenches is selected from the group consisting of an open end wrench, a box end wrench, an allen wrench and a ratchet wrench adapted for attachment of a multisocket;

f) wherein in the extended position the first and second folding arms function as a pair of handles for use of the pliers head assembly;

g) wherein the set of wrenches comprises at least two wrench heads and h) wherein at least two of the at least two wrench heads comprise a duplex and/or overlapped wrench head.

2. The hand tool in claim 1, wherein the first and second folding arms each can be used as a tool handle in both the extended position and the stowed position.

3. The hand tool in claim 1, wherein the stowed position is defined by the first and second folding arms being positioned longitudinally adjacent the pliers head assembly.

4. The hand tool in claim 1, wherein at least two of the at least two wrench heads comprise a double nested wrench head.

5. The hand tool in claim 1, wherein at least two of the at least two wrench heads comprise a double nested wrench head, wherein each double nested wrench head comprises a first and second pivotal wrench heads each with a pivotal portion, wherein the pivotal portion of the second wrench head is nested inside the pivotal portion of the first wrench head.

6. The hand tool in claim 1, wherein at least two of the at least two wrench heads comprise a double nested duplex wrench head.

7. The hand tool in claim 1, wherein the full set of wrenches comprises a ratchet wrench adapted for attachment of a multisocket.

8. The hand tool in claim 1, wherein the pliers head assembly comprises a multifunction pliers, whereby the pliers head assembly incorporates multiple plies types comprising cutters, strippers, grippers, and/or crimpers.

9. The hand tool in claim 1, wherein the first and second folding axes are substantially parallel to the pivotal axis of the pliers hinge.

10. The hand tool in claim 1, wherein the first and second folding axes are substantially perpendicular to the pivotal axis of the pliers hinge.

11. The hand tool in claim 1, wherein the set of wrenches comprises two or more wrench heads and two or more rotary fastener gripping surfaces, wherein each rotary fastener gripping surface defines a turning axis for turning a rotary fastener, wherein the first and second folding axes are substantially perpendicular to the turning axes of the two or more rotary fastener gripping surfaces.

12. The hand tool in claim 1, wherein the set of wrenches defines two or more wrench heads and four or more rotary fastener gripping surfaces, wherein each rotary fastener gripping surface defines a turning axis for turning a rotary fastener, wherein the first and second folding axes are substantially parallel to the turning axes of the two or more rotary fastener gripping surfaces, wherein the first and second folding axes comprise a locking mechanism for alternately locking the first and second arms at least one particular orientation with respect to the pliers head assembly.

13. The hand tool in claim 1, wherein the first and second folding arms are pivotal to a substantially adjacent and substantially parallel position with respect to the pliers head assembly in the stowed position.

14. The hand tool in claim 1, further comprising an additional tool other than a set of wrenches and the pliers.

15. The hand tool in claim 14, wherein the additional tool comprises screwdrivers, a knife, an allen wrench set, a hammer, a scissor, a pry tool, a flashlight, a bottle opener, a can opener, a nail file, a fishing tool, a spoke wrench, a bicycle chain tool and/or various other hand tools.

16. The multitool of claim 1, wherein the first and second folding arms each comprise two or more pivotally separable folding arms, wherein at least four of the separable folding arms comprise at least one wrench head.

17. A multitool, comprising:

a) a pliers head assembly comprising a first and second matching plier sections pivotally attached at a pliers hinge defining a pivotal axis;

b) a first and second folding arm each comprising a first and second end;

c) wherein the first and second folding arms each comprises a folding axis for pivotal attachment to the first and second matching plier sections respectively;

d) wherein the first and second folding arms are each pivotal to an extended position and a stowed position;

e) wherein the first and second folding arms in their extended positions can be used as handles for use with the pliers head assembly, and f) wherein the second end of the first folding arm comprises a first wrench head with at least two different rotary fastener gripping surface sizes, and wherein the second end of the second folding arm comprises a second wrench head with at least two different rotary fastener gripping surface sizes.

18. The multitool in claim 17, wherein the first and second folding axes are substantially parallel to the pivotal axis of the pliers hinge, wherein the plier head assembly comprises a compound pliers assembly.

19. The multitool in claim 17, wherein the first and second folding axes are substantially perpendicular to the pivotal axis of the pliers hinge, wherein the plier head assembly comprises a compound pliers assembly.

20. The multitool in claim 17, wherein the first folding arm comprises two or more pivotally separable folding arms, wherein at least two of the first folding arm's two or more pivotally separable folding arms comprise at least one wrench head; wherein the second folding arm comprises two or more pivotally separable folding arms, wherein at least two of the second folding arm's two or more pivotally separable folding arms comprise at least one wrench head.

* * * * *